US011317749B2

(12) United States Patent
Tsai

(10) Patent No.: US 11,317,749 B2
(45) **Date of Patent: *May 3, 2022**

(54) MODULAR ELECTRICAL DISTRIBUTION SYSTEM FOR AN ILLUMINABLE DECORATION, AND ILLUMINABLE DECORATION WITH MODULAR ELECTRICAL DISTRIBUTION SYSTEM

(71) Applicant: Chang Fu Tsai, Taichung (TW)

(72) Inventor: Chang Fu Tsai, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/226,228

(22) Filed: Apr. 9, 2021

(65) Prior Publication Data

US 2022/0047106 A1 Feb. 17, 2022

Related U.S. Application Data

(63) Continuation of application No. 16/994,991, filed on Aug. 17, 2020, now Pat. No. 10,973,354.

(51) Int. Cl.

| | |
|---|---|
| ***H01R 33/06*** | (2006.01) |
| ***A47G 33/06*** | (2006.01) |
| ***A47G 33/08*** | (2006.01) |
| ***H01R 24/38*** | (2011.01) |
| ***H01R 13/10*** | (2006.01) |
| *H01R 103/00* | (2006.01) |
| *F21W 121/04* | (2006.01) |

(52) U.S. Cl.

CPC ..... *A47G 33/06* (2013.01); *A47G 33/08* (2013.01); *H01R 13/10* (2013.01); *H01R 24/38* (2013.01); *H01R 33/06* (2013.01); *A47G 2033/0827* (2013.01); *F21W 2121/04* (2013.01); *H01R 2103/00* (2013.01)

(58) Field of Classification Search

CPC ..... A47G 33/08; H01R 13/10; H01R 24/38

See application file for complete search history.

(56) References Cited

U.S. PATENT DOCUMENTS

| | | | | |
|---|---|---|---|---|
| 7,066,739 | B2 * | 6/2006 | McLeish ..... | H01R 13/6205 439/39 |
| 2006/0063409 | A1 * | 3/2006 | Wang ..... | H01R 13/7033 439/188 |

(Continued)

*Primary Examiner* — Evan P Dzierzynski

(74) *Attorney, Agent, or Firm* — Thomas E. Lees, LLC

(57) ABSTRACT

An illuminable decoration comprises at least two trunk sections, each trunk section includes a hollow tube and a cable assembly coupled to each trunk section. Each cable assembly comprises a first modular electrical connector end that has an inner socket and an outer plug that circumscribes the inner socket. Further, each cable assembly comprises a second modular electrical connector end that has an inner plug and an outer socket that circumscribes the inner plug. A first electrical wire electrically couples between the inner socket of the first modular electrical connector and the inner plug of the second modular electrical connector. Also, a second electrical wire electrically couples between the outer plug of the first modular electrical connector and the outer socket of the second modular electrical connector. When two trunk sections are assembled together end-to-end, the trunk sections are mechanically and electrically coupled to form a modular electrical distribution system.

25 Claims, 21 Drawing Sheets

(56) References Cited

U.S. PATENT DOCUMENTS

| | | | | |
|---|---|---|---|---|
| 2013/0301247 | A1* | 11/2013 | Chen | A41G 1/007<br>362/123 |
| 2015/0099391 | A1* | 4/2015 | Hashimoto | H01R 13/629<br>439/380 |
| 2016/0043505 | A1* | 2/2016 | Wu | H01R 35/02<br>439/217 |
| 2016/0278559 | A1* | 9/2016 | Leung | A47G 33/06 |

* cited by examiner

MODULAR ELECTRICAL DISTRIBUTION SYSTEM FOR AN ILLUMINABLE DECORATION, AND ILLUMINABLE DECORATION WITH MODULAR ELECTRICAL DISTRIBUTION SYSTEM

CROSS REFERENCE TO RELATED APPLICATIONS

This application is a continuation of U.S. patent application Ser. No. 16/994,991, filed Aug. 17, 2020, now allowed, entitled "MODULAR ELECTRICAL DISTRIBUTION SYSTEM FOR AN ILLUMINABLE DECORATION, AND ILLUMINABLE DECORATION WITH MODULAR ELECTRICAL DISTRIBUTION SYSTEM", the disclosure of which is hereby incorporated herein by reference.

BACKGROUND

Field of the Invention

Various aspects of the present invention relate generally to electrical distribution systems that are suitable for use with illuminable decorations. In particular, aspects relate to a modular electrical distribution system usable with illuminable decorations, such as artificial illuminated trees, and to illuminable decorations, such as artificial trees, having a modular electrical distribution system integrated therewith.

Description of Related Art

Decorations such as artificial trees, can be provided in segmented components that are assembled into a final form. The segments provide convenience for packing, storing, and transportation. However, the segments require assembly when it is desirable to place the decoration out for display.

For instance, in a decoration such as a holiday tree, a user typically mounts a first section resembling a tree trunk to a base, e.g., a tree stand. The first section may have branches pre-installed, or the branches themselves may be separate components. After assembling the first section to the base, the individual continues, assembling a second section to the first section. This process continues, stacking sections until the decoration is fully assembled into an artificial tree. In some implementations, the individual can then decorate the tree with lights. In other implementations, lights are pre-strung on the segments and/or branches.

BRIEF SUMMARY

According to aspects of the present disclosure, an illuminable decoration is provided. The illuminable decoration comprises a first trunk section and a second trunk section. Here, the first trunk section and the second trunk section are each comprised of a hollow tube. Additionally, a first cable assembly is coupled to the first trunk section. The first cable assembly comprises a first modular electrical connector end, where the first modular electrical connector end has an inner socket and an outer plug that at least partially circumscribes the inner socket. The first cable assembly also includes a second modular electrical connector end. The second modular electrical connector end has an inner plug and an outer socket that at least partially circumscribes the inner plug. A first electrical wire is electrically coupled between an electrical contact of the inner socket of the first modular electrical connector end, and an electrical contact of the inner plug of the second modular electrical connector end. Likewise, a second electrical wire is electrically coupled between an electrical contact of the outer plug of the first modular electrical connector end, and an electrical contact of the outer socket of the second modular electrical connector end. A second cable assembly is coupled to the second trunk section. Here, the second cable assembly comprises at least one of a first modular electrical connector end and a second modular electrical connector end. Here, the first modular electrical connector end has an inner socket and an outer plug that circumscribes the inner socket. Correspondingly, the second modular electrical connector end having an inner plug and an outer socket that circumscribes the inner plug. When the first trunk section is assembled to the second trunk section end-to-end, the first trunk section and the second trunk section are mechanically connected along an axial dimension, and the first cable assembly is mechanically and electrically connected to the second cable assembly so as to form a modular electrical distribution system.

According to further aspects of the present disclosure, a cable assembly is provided. The cable assembly comprises a first modular electrical connector end, and a second modular electrical connector end. The first modular electrical connector end has an inner socket and an outer plug that circumscribes and is spaced from the inner socket. Correspondingly, the second modular electrical connector end has an inner plug and an outer socket that circumscribes and is spaced from the inner plug. A first electrical wire is electrically coupled between an electrical contact of the inner socket of the first modular electrical connector end, and an electrical contact of the inner plug of the second modular electrical connector end. Analogously, a second electrical wire is electrically coupled between an electrical contact of the outer plug of the first modular electrical connector end, and an electrical contact of the outer socket of the second modular electrical connector end. When two cable assemblies are assembled together end-to-end, the two cable assemblies are mechanically connected along an axial dimension so as to form a modular electrical distribution system, such that the inner socket of the first modular electrical connector end of a first one of the cable assemblies electrically and mechanically connects to the inner plug of the second modular electrical connector end of a second one of the cable assemblies, and the outer plug of the first modular electrical connector end of the first one of the cable assemblies electrically and mechanically connects to the outer socket of the second modular electrical connector end of the second one of the cable assemblies.

DETAILED DESCRIPTION

Aspects herein provide a modular electrical distribution system usable with illuminable decorations, such as artificial illuminated trees. Aspects also provide illuminable decorations, such as artificial trees, having a modular electrical distribution system integrated therewith.

By way of example, an illuminable decoration implemented as an artificial tree may include lights thereon, or the artificial tree may include provisions for an individual to add lights, e.g., to the branches of the artificial tree. In view of the above, power must be provided to the lights. Accordingly, aspects herein provide a modular electrical distribution system uses an interior hollow of a trunk of the artificial tree as a conduit. In this configuration, an electrical connection is made substantially simultaneously with the joining of the trunk sections to form the trunk of the artificial tree. That is, assembly of the trunk sections automatically forms the electrical connections necessary to provide power through the trunk.

Moreover, in some embodiments, a rotational orientation of the trunk sections is independent of forming the electrical connections. As such, an individual does not need to align the electrical connectors or have any special knowledge of electrical connections. Moreover, in some embodiments, the electrical connectors are positioned proximate to the axial ends of each trunk section. For instance, the electrical connectors can be recessed into the hollow of the trunk sections proximate to the axial ends of each trunk section. As such, the individual assembling the trunk sections need not even be aware of how to make electrical connections, because the electrical connections are made positively and automatically for the user by virtue of the mechanical assembly of the trunk sections.

By providing power through the trunk, the decoration herein can include built in lights that receive power. Alternatively, an individual may be able to add lights, or to plug lights into one or more connectors (such as outlets or plugs) conveniently provided on or near the trunk. Here, each connector receives power via the modular electrical distribution system. In other embodiments, one or more power cables may extend from the trunk, where the power cables each include at least one connector (e.g., outlet or plug).

First Modular Electrical Connector End

Figure 1A:
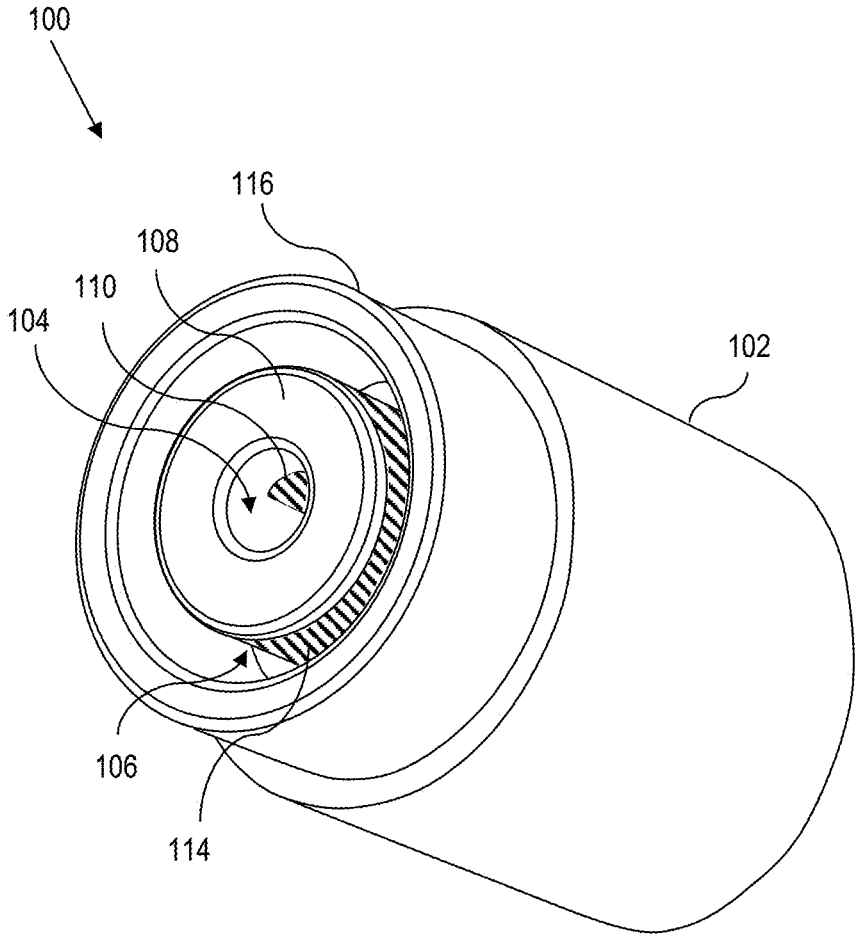
FIG. 1A illustrates a first modular electrical connector end usable with a modular electrical distribution system.

Referring now to the drawings, and in particular to FIG. 1A, an example embodiment of a first modular electrical connector end 100 is illustrated.

The illustrated first modular electrical connector end 100 includes in general, a body 102 that supports an inner socket 104 and an outer plug 106. The outer plug 106 at least partially circumscribes and is spaced outwardly from the inner socket 104 and is spaced therefrom by a tubular insulator 108. As illustrated, the tubular insulator 108 is a generally cylindrical projection that extends from an end face of the body 102. Moreover, the tubular insulator 108 defines a body or portion thereof for the inner socket 104, and a body or portion thereof for the outer plug 106. As illustrated, the end face of the tubular insulator 108 forms an annular ring of insulative material that provides stiffness and strength to the inner socket 104 and outer plug 106.

More particularly, the inner socket 104 of the first modular electrical connector end 100 is defined by an interior or hollow of the tubular insulator 108. For instance, as illustrated, the diameter of the inner socket 104 is defined by the inside diameter of the annular ring (or hollow) of the tubular insulator 108. The inside diameter of the annular ring, along with the depth of the hollow, thus form a receptacle of the inner socket 104. The inner socket 104 comprises an electrical contact 110, e.g., a conductive tab on an inside surface of the tubular insulator 108, a flat conductive pad, a conductive ring or band that circumscribes the inside diameter of the tubular insulator 108, an arcuate conductive surface that covers only a portion of the inside diameter of the tubular insulator 108, a conductive structure having a spring characteristic, etc.

Notably, a spring characteristic can be provided in any of the above-structures. For instance, the spring characteristic of the electrical contact 110, when implemented, can be one or more of a spring finger contact, clip, multi-directional spring contact, a spring tab, etc. As further examples, the spring characteristic can be built into a ring or band of metal surrounding the inside diameter of the tubular insulator 108, which is implemented as a set of leaf springs, a cylinder with at least one leaf spring, a band having a set of axial slits with a central, radially inward bulge, a spring or clip that applies force (radially inward or radially outward) to ensure good electrical contact with a mating contact, etc.

As will be described in greater detail herein, the electrical contact 110 facilitates an electrical connection to a wire of the modular electrical distribution system. In the illustrated example, because of the hollow and the positioning of the tubular insulator 108, there is no conductor that is coaxial with the first modular electrical connector end 100. Rather, the electrical contact 110 is offset relative to a coaxial dimension.

The outer plug 106 of the first modular electrical connector end 100 is defined by an exterior surface of the tubular insulator 108. For instance, as illustrated, the diameter of the outer plug 106 is defined by the outside diameter of the annular ring of the tubular insulator 108. The distance from the annular ring (end face of the tubular insulator 108) to the body 102 (height of the tubular insulator 108 projecting from the body 102) thus defines a length of the outer plug 106. An electrical contact 114, e.g., a conductive material is positioned on at least a portion of an outside surface of the tubular insulator 108, thus defining the conductor of the outer plug 106. As will be described in greater detail herein, the conductive material of the outer plug 106 facilitates an electrical connection to a wire of the modular electrical distribution system. In practice, the electrical contact 114 can be implemented as a conductive tab on the outside surface of the tubular insulator 108, a conductive pad, a conductive ring or band that circumscribes the outside diameter of the tubular insulator 108, an arcuate conductive surface that covers only a portion of the outside diameter of the tubular insulator 108, a conductive structure having a spring characteristic, etc.

Notably, a spring characteristic can be provided in any of the above-structures. For instance, the spring characteristic, where provided, can be built into a ring or band of metal surrounding the outside diameter of the tubular insulator 108, which is implemented as a set of leaf springs, a cylinder with at least one leaf spring, a band having a set of axial slits with a central bulge, a spring that applies outward force to ensure good electrical contact with a mating contact, etc. Also, the electrical contact 114 can be implemented with a spring characteristic by providing one or more of a spring finger contact, clip, multi-directional spring contact, spring tab, etc.

As noted above, the tubular insulator 108 serves as a body for both the inner socket 104 and the outer plug 106. Thus, the tubular insulator 108 enables a plug with an internal, coaxially aligned and recessed socket. In other embodiments (not illustrated in FIG. 1A), the inner socket 104 and the outer plug 106 are each on a separate insulator body, e.g., concentric tubular projections. In yet other embodiments, the outer plug 106 is implemented on a tubular projection away from the body 102, and the inner socket 104 is recessed into a cylindrical aperture that extends into the body 102.

The first modular electrical connector end 100 of FIG. 1A also includes an optional outer wall 116. In this regard, the outer wall 116 is an insulator that forms a concentric outer ring that circumscribes and is spaced outwardly from both the inner socket 104 and the outer plug 106 of the first modular electrical connector end 100. The outer wall 116 can be utilized for example, to isolate any conductive portion of the first modular electrical connector end 100, to provide a guide surface or abutment surface for mechanical coupling, to provide alignment of trunk sections, or for other purposes.

Figure 1B:
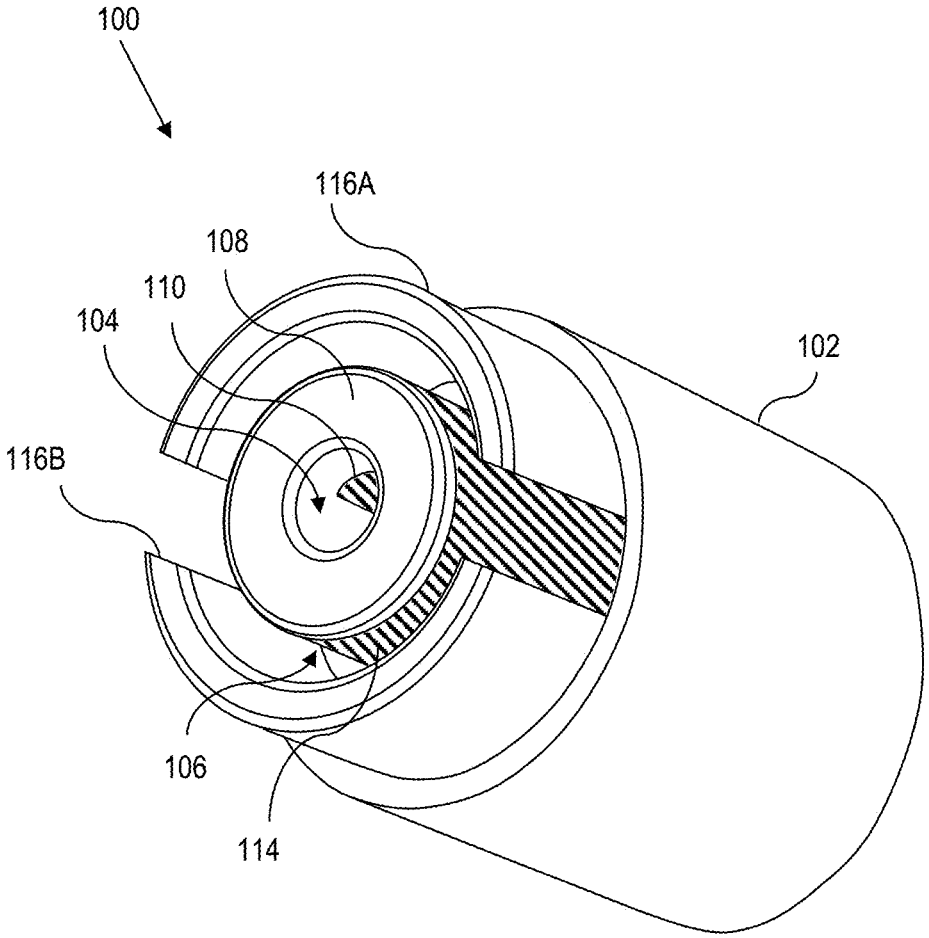
FIG. 1B illustrates an alternative embodiment of a first modular electrical connector end usable with a modular electrical distribution system.

Referring to FIG. 1B, another example embodiment of a first modular electrical connector end 100 is illustrated. The illustrated first modular electrical connector end 100 is similar to the first modular electrical connector end 100 of FIG. 1A unless otherwise noted. As such, like elements are illustrated with like reference numbers. Moreover, similar elements will not be described in detail. Rather, the disclosure with regard to similar elements to that of FIG. 1A is adopted by analogy.

Analogous to FIG. 1A, the illustrated first modular electrical connector end 100 includes a body 102 having an inner socket 104 and an outer plug 106. The outer plug 106 at least partially circumscribes and is spaced outwardly from the inner socket 104 and is spaced therefrom by a tubular insulator 108. The inner socket 104 comprises an electrical contact 110, e.g., a conductive tab as illustrated on an inside surface of the tubular insulator 108. However, the electrical contact 110 can take any form or structure as set out in greater detail with reference to FIG. 1A. Also, the outer plug 106 comprises an electrical contact 114, e.g., a conductive material positioned on an outside surface of the tubular insulator 108. However, the electrical contact 114 can take any form or structure as set out in greater detail with reference to FIG. 1A.

The embodiment of FIG. 1B differs from the embodiment of FIG. 1A in that the outer wall 116 of FIG. 1A is replaced by outer wall segments, illustrated by a first outer wall segment 116A and a second outer wall segment 116B. The first outer wall segment 116A is spaced from the second outer wall segment 116B by a gap at each end. Thus, there is no annular ring formed entirely around the tubular insulator 108 like the outer wall 116 of FIG. 1A. Rather, the segments form spaced projections of non-conductive material. The use of outer wall segments may be utilized, for instance, to provide a tolerance with regard to a mating component by allowing a "spring action" of the segments to create a solid mechanical coupling. In practice, there can be more segments than the first and second segments illustrated.

Figure 1C:
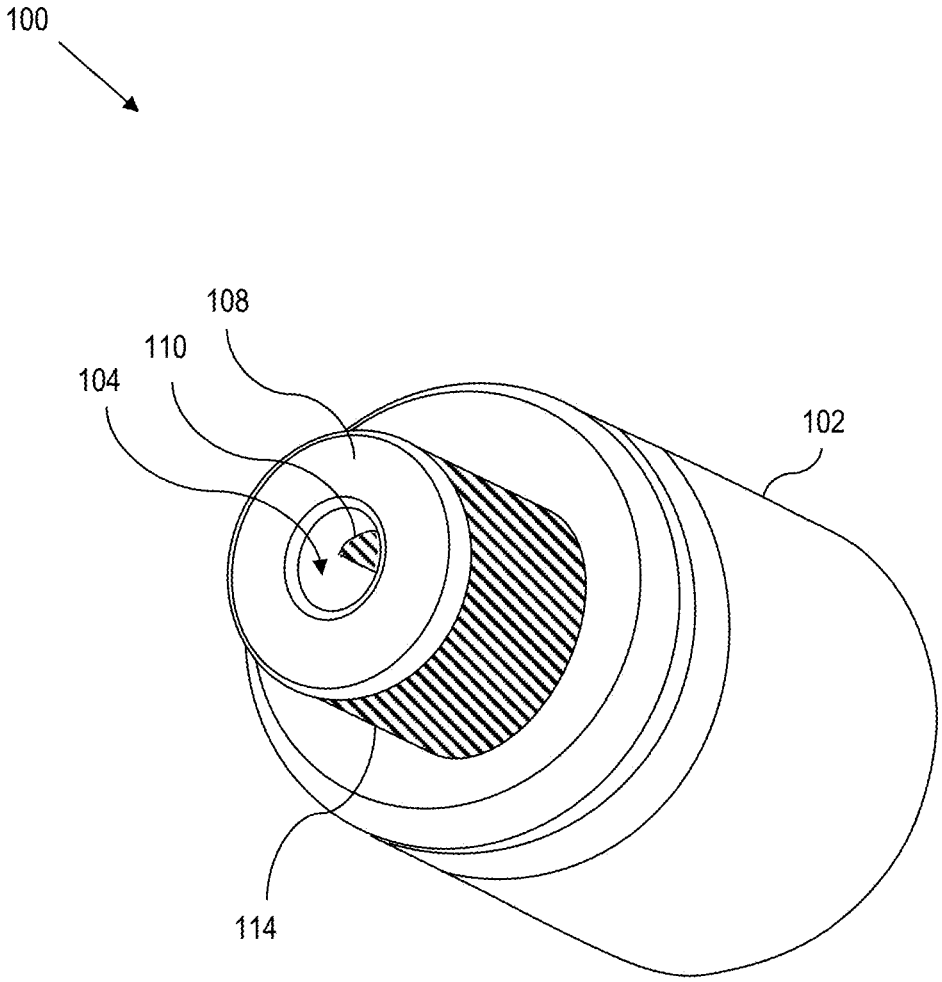
FIG. 1C illustrates another alternative embodiment of a first modular electrical connector end usable with a modular electrical distribution system.

Referring to FIG. 1C, yet another example embodiment of a first modular electrical connector end 100 is illustrated. The illustrated first modular electrical connector end 100 is similar to the first modular electrical connector end 100 of FIG. 1A unless otherwise noted. As such, like elements are illustrated with like reference numbers. Moreover, similar elements will not be described in detail. Rather, the disclosure with regard to similar elements to that of FIG. 1A is adopted by analogy.

Analogous to FIG. 1A, the illustrated first modular electrical connector end 100 includes a body 102 having an inner socket 104 and an outer plug 106. The outer plug 106 at least partially circumscribes and is spaced outwardly from the inner socket 104 and is spaced therefrom by a tubular insulator 108. The inner socket 104 comprises an electrical contact 110, e.g., a conductive tab illustrated on an inside surface of the tubular insulator 108. However, the electrical contact 110 can take any form or structure as set out in greater detail with reference to FIG. 1A. Also, the outer plug 106 comprises an electrical contact 114, e.g., a conductive material positioned on an outside surface of the tubular insulator 108. However, the electrical contact 114 can take any form or structure as set out in greater detail with reference to FIG. 1A.

Notably, in the embodiment of FIG. 1C, there is no outer wall analogous to the outer wall 116 of FIG. 1A. Rather, the embodiment of FIG. 1C includes a single projection (i.e., the tubular insulator 108) from the face of the body 102. Here, the tubular insulator 108 provides the electrical connection and can form, or contribute to the mechanical coupling to a corresponding connector end as described in greater detail herein.

Figure 1D:
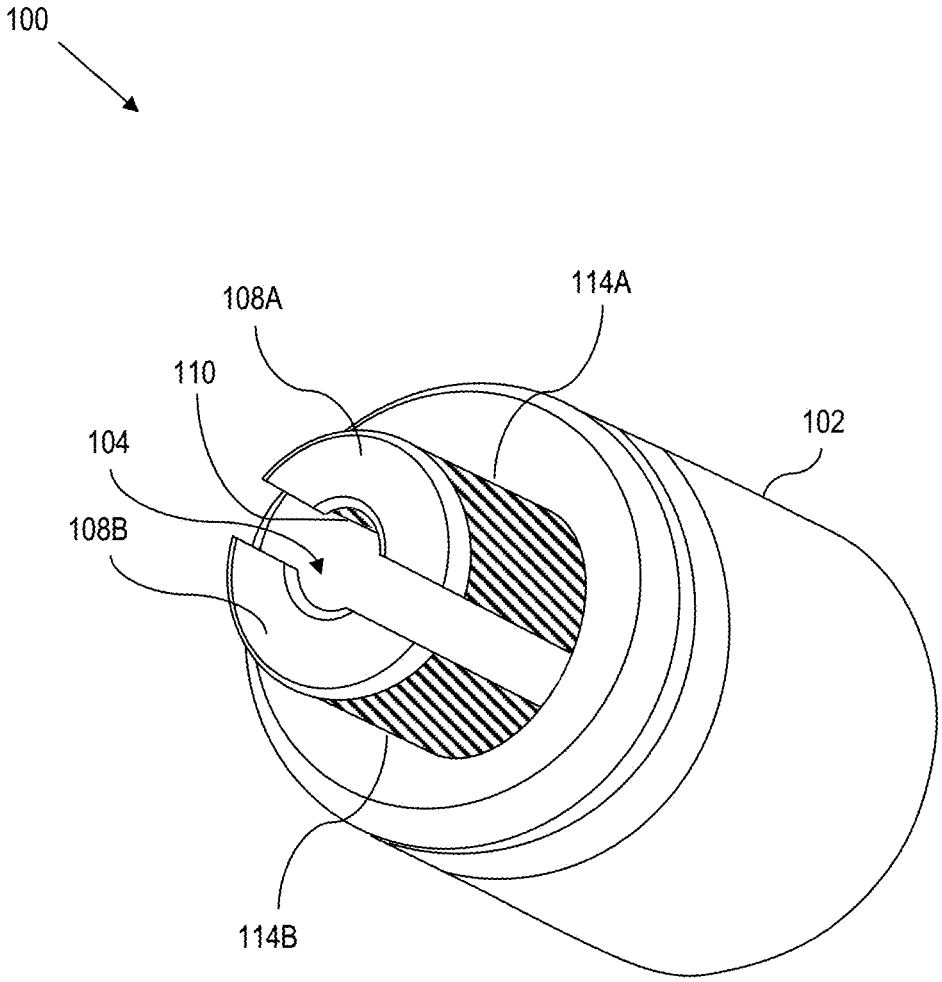
FIG. 1D illustrates yet another alternative embodiment of a first modular electrical connector end usable with a modular electrical distribution system.

Referring to FIG. 1D, yet another example embodiment of a first modular electrical connector end 100 is illustrated. The illustrated first modular electrical connector end 100 is similar to the first modular electrical connector end 100 of FIG. 1A unless otherwise noted. As such, like elements are illustrated with like reference numbers. Moreover, similar elements will not be described in detail. Rather, the disclosure with regard to similar elements to that of FIG. 1A is adopted by analogy.

Analogous to FIG. 1A, the illustrated first modular electrical connector end 100 includes a body 102 having an inner socket 104 and an outer plug 106. Notably however, the outer plug 106 only partially circumscribes and is spaced outwardly from the inner socket 104. More particularly, the outer plug 106 is spaced from the inner socket 104 by a split insulator defined by a first insulator segment 108A and a second insulator segment 108B. In practice, there can be more segments than that shown. Moreover, the electrical contact 214 can be provided on any one or more insulator segments.

The inner socket 104 comprises an electrical contact 110, e.g., a conductive tab as illustrated on an inside surface of the first insulator segment 108A. However, the electrical contact 110 can take any form or structure as set out in greater detail with reference to FIG. 1A. Also, the outer plug 106 comprises an electrical contact 114, e.g., a electrical contact 114A positioned on an outside surface of the first insulator segment 108A, and an electrical contact, e.g., a electrical contact 114B positioned on an outside surface of the second insulator segment 108B. However, the electrical contact 114 can take an alternative form or structure as set out in greater detail with reference to FIG. 1A. Also, in the embodiment of FIG. 1D, there is no outer wall analogous to the outer wall 116 of FIG. 1A (much like the embodiment of FIG. 1C).

As illustrated, the first insulator segment 108A is spaced from the second insulator segment 108B by a gap at each end. Thus, there is no annular ring formed by the insulator segments. The use of insulator segments can be utilized to provide a tolerance with regard to a mating component by allowing a "spring action" of the segments to create a solid mechanical coupling.

Figure 1E:
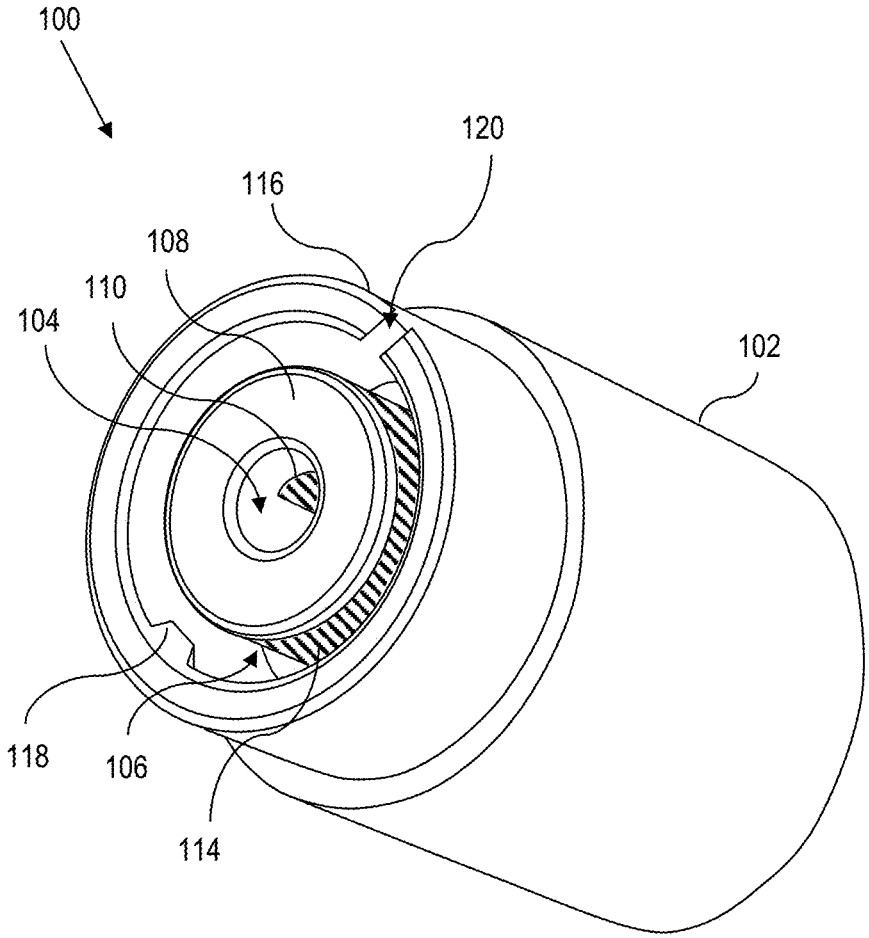
FIG. 1E illustrates still another alternative embodiment of a first modular electrical connector end usable with a modular electrical distribution system.

Referring to FIG. 1E, still another example embodiment of a first modular electrical connector end 100 is illustrated. The illustrated first modular electrical connector end 100 is similar to the first modular electrical connector end 100 of FIG. 1A unless otherwise noted. As such, like elements are illustrated with like reference numbers. Moreover, similar elements will not be described in detail. Rather, the disclosure with regard to similar elements to that of FIG. 1A is adopted by analogy.

Analogous to FIG. 1A, the illustrated first modular electrical connector end 100 includes a body 102 having an inner socket 104 and an outer plug 106. The outer plug 106 at least partially circumscribes and is spaced outwardly from the inner socket 104 and is spaced therefrom by a tubular insulator 108. The inner socket 104 comprises an electrical contact 110, e.g., a conductive tab as illustrated on an inside surface of the tubular insulator 108. However, the electrical contact 110 can take any form or structure as set out in greater detail with reference to FIG. 1A. Also, the outer plug 106 comprises an electrical contact 114, e.g., a conductive material positioned on an outside surface of the tubular insulator 108. However, the electrical contact 114 can take any form or structure as set out in greater detail with reference to FIG. 1A.

The embodiment of FIG. 1E differs from the embodiment of FIG. 1A in that the outer wall 116 of FIG. 1A is replaced by an outer wall 116 that further includes a key 118 and/or a notch 120. The key 118 and/or notch 120 can be utilized for configurations that require a specific alignment of the first modular electrical connector end 100 to a mating component. The key 118 and/or notch 120 can also be integrated into other embodiments that include an outer wall, e.g., the embodiment of FIG. 1B.

Second Modular Electrical Connector End

Figure 2A:
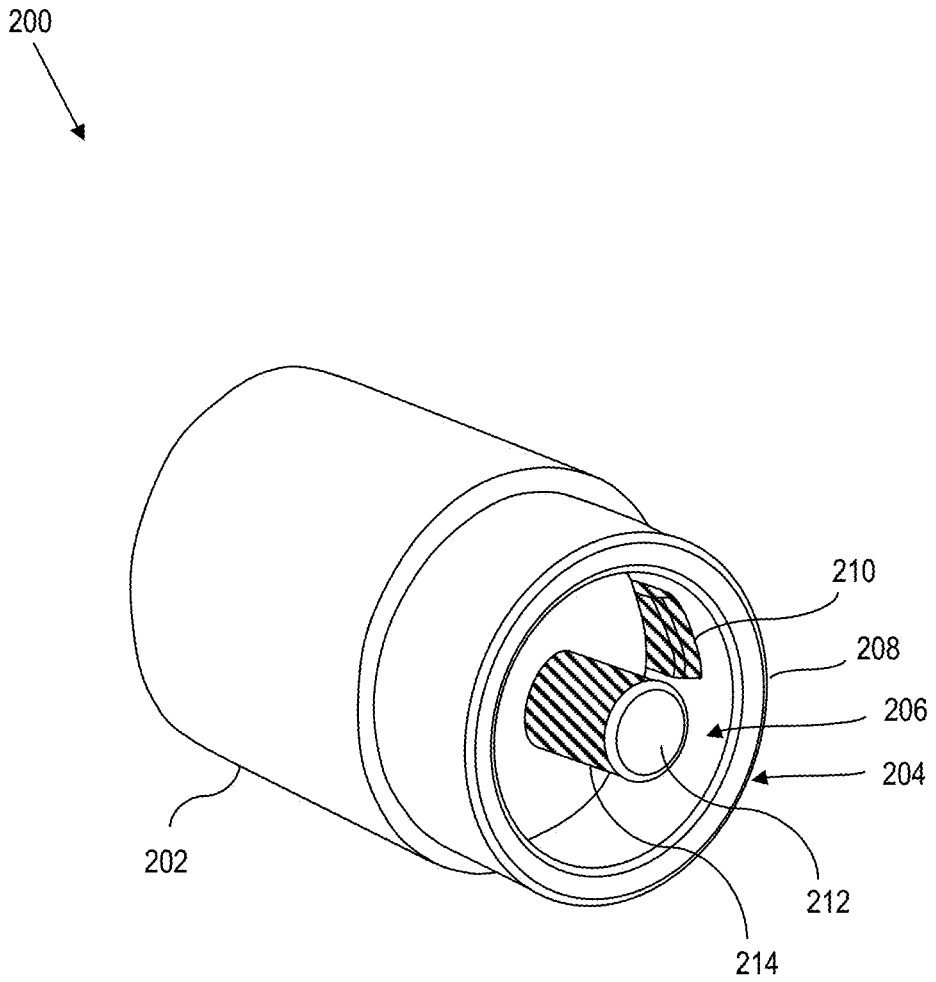
FIG. 2A illustrates a second modular electrical connector end usable with a modular electrical distribution system.

Referring to FIG. 2A, an example second modular electrical connector end 200 is illustrated. The second modular electrical connector end 200 is usable with a modular electrical distribution system, and can be utilized in cooperation with any of the first modular electrical connector end 100 (FIG. 1A-FIG. 1E), as will be described in greater detail herein.

The example second modular electrical connector end 200 includes in general, a body 202 that supports an outer socket 204 and an inner plug 206. The outer socket 204 at least partially circumscribes, and is spaced outwardly from the inner plug 206. In some embodiments, the spacing between the outer socket 204 and the inner plug 206 corresponds to the dimensions of the annular ring of the tubular insulator 108 (FIG. 1A), the first insulator segment 108A and the second insulator segment 108B (FIG. 1D), etc.

The outer socket 204 of the second modular electrical connector end 200 is defined by a tubular insulator 208 that projects from the body 202. A space within an inside diameter of the tubular insulator 208, along with the depth of the space within the tubular insulator 208, forms a receptacle of the outer socket 204. In this regard, an electrical contact 210 is positioned on an inside surface of the tubular insulator 208. The electrical contact 210 can comprise a conductive tab, a flat conductive pad, a conductive ring or band that circumscribes the inside diameter of the tubular insulator 208, an arcuate conductive surface that covers only a portion of the inside diameter of the tubular insulator 208, a conductive structure having a spring characteristic, etc.

Notably, a spring characteristics can be provided in any of the above-structures. For example, the spring characteristic of the electrical contact 210, where provided, can be implemented as one or more of a spring finger contact, clip, multi-directional spring contact, tab spring, etc. As additional examples, the spring characteristic can be built into a ring or band of metal surrounding the inside diameter of the tubular insulator 208, which is implemented as a set of leaf springs, a cylinder with at least one leaf spring, a band having a set of axial slits with a central, radially inward bulge, a spring or clip that applies force (radially inward or radially outward) to ensure good electrical contact with a mating contact, etc. As will be described in greater detail herein, the electrical contact 210 facilitates an electrical connection to a wire of the modular electrical distribution system.

The inner plug 206 of the second modular electrical connector end 200 is defined by an exterior surface of an insulator 212 that projects from the body 202. In some embodiments, the insulator 212 is coaxial with, and is circumscribed at least partially by the tubular insulator 208. Thus, the insulator 212 is within the tubular insulator 208. For instance, the insulator 212 is illustrated as having an outside diameter that projects from the body 202, thus exposing an outside surface thereof. In some embodiments, the insulator 212 is a tubular insulator, and is thus hollow. In other embodiments, the insulator 212 is solid.

An electrical contact 214 is positioned on at least a portion of the outside surface of the insulator 212, thus defining the conductor of the inner plug 206. As will be described in greater detail herein, the electrical contact 214 of the inner plug 206 facilitates an electrical connection to a wire of the modular electrical distribution system. Analogous to that described more fully herein, the electrical contact 214 can be implemented as a conductive material, a conductive tab on the outside surface of the insulator 212, a conductive pad, a conductive ring or band that circumscribes the outside diameter of the insulator 212, an arcuate conductive surface that covers only a portion of the outside diameter of the insulator 212, a conductive structure having a spring characteristic, etc.

Notably, a spring characteristics can be provided in any of the above-structures. For instance, the spring characteristic, where provided, can be built into a ring or band of metal surrounding the outside diameter of the insulator 212, which is implemented as a set of leaf springs, a cylinder with at least one leaf spring, a band having a set of axial slits with a central bulge, a spring that applies outward force to ensure good electrical contact with a mating contact, etc. Also, the electrical contact 214 can be implemented as one or more of a spring finger contact, clip, multi-directional spring contact, spring tab, etc.

Since the outer socket 204 circumscribes and is spaced outwardly from the inner plug 206, the outer socket 204 and the inner plug 206 can be each formed on separate insulators (i.e., tubular insulator 208 and insulator 212 respectively). In the example the tubular insulator 208 and insulator 212 are formed as concentric tubular rings extending from the housing. In other embodiments, the plug 206 is implemented on a projection, and the socket 204 is recessed into a cylindrical aperture that extends into the body 102.

Figure 2B:
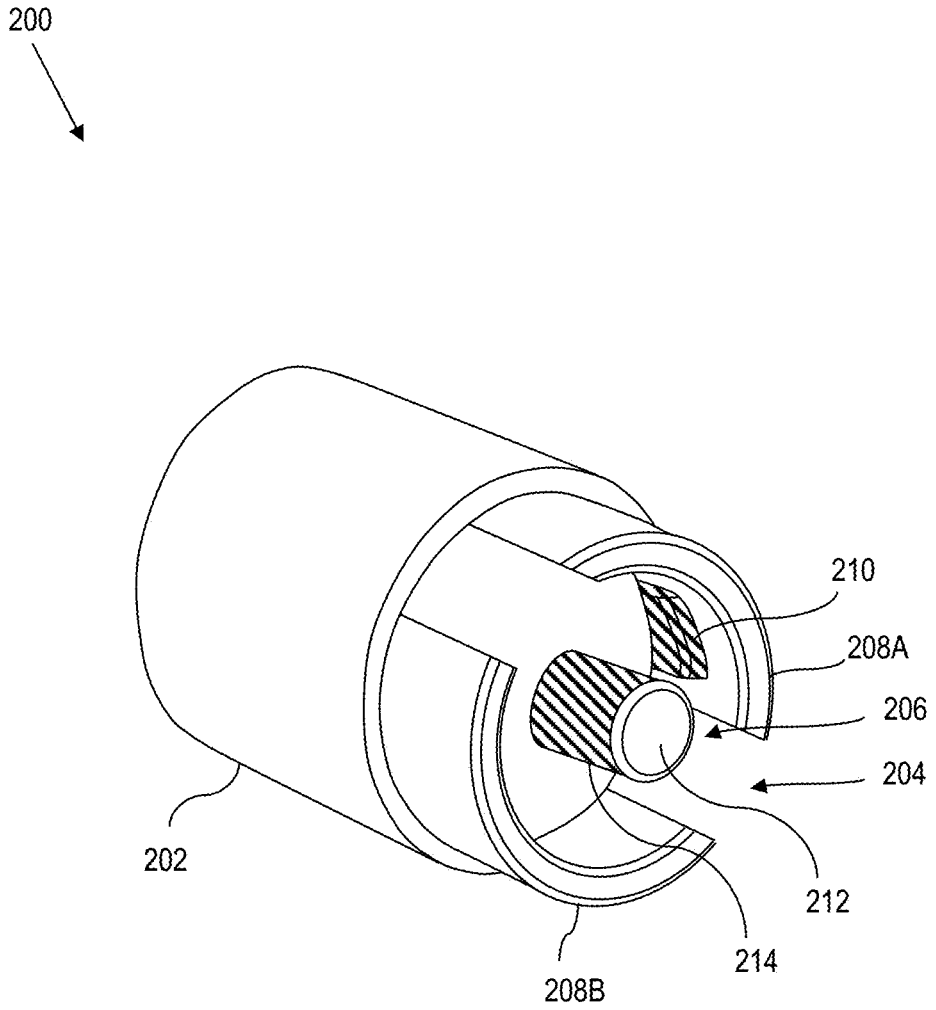
FIG. 2B illustrates an alternative embodiment of a second modular electrical connector end usable with a modular electrical distribution system.

Referring to FIG. 2B, an alternative configuration is illustrated. The configuration of FIG. 2B is identical to that of FIG. 2A except that the tubular insulator 208 of FIG. 2A is replaced by two or more arcuate sections (e.g., 208A, 208B) such that there is an air gap between each arcuate section. At least one of the arcuate sections includes the electrical contact 210.

Analogous to FIG. 2A, the illustrated second modular electrical connector end 200 includes a body 202 having an outer socket 204 and an inner plug 206. The outer socket 204 comprises an electrical contact, e.g., a electrical contact 210. Also, the inner plug 106 comprises an electrical contact, e.g., a electrical contact 214 positioned on an outside surface of an insulator 212.

However, the embodiment of FIG. 2B differs from the embodiment of FIG. 2A in that tubular insulator 208 of FIG. 2A is replaced by insulator segments, illustrated by a first insulator segment 208A and a second insulator segment 208B. The electrical contact 210 is positioned on the first insulator segment 208A solely for clarity of illustration. In practice, there can be a electrical contact 210 on each insulator segment. Moreover, there can be more than two insulator segments.

The first insulator segment 208A is spaced from the second insulator segment 208B by a gap at each end. Thus, there is no annular ring formed entirely around the tubular insulator 212 like the tubular insulator 208 of FIG. 1A. Rather, the segments form spaced projections of non-conductive material. The use of insulator segments may be utilized, for instance, to provide a tolerance with regard to a mating component by allowing a "spring action" of the segments to create a solid mechanical coupling. In practice, there can be more segments than the first and second segments illustrated.

Figure 2C:
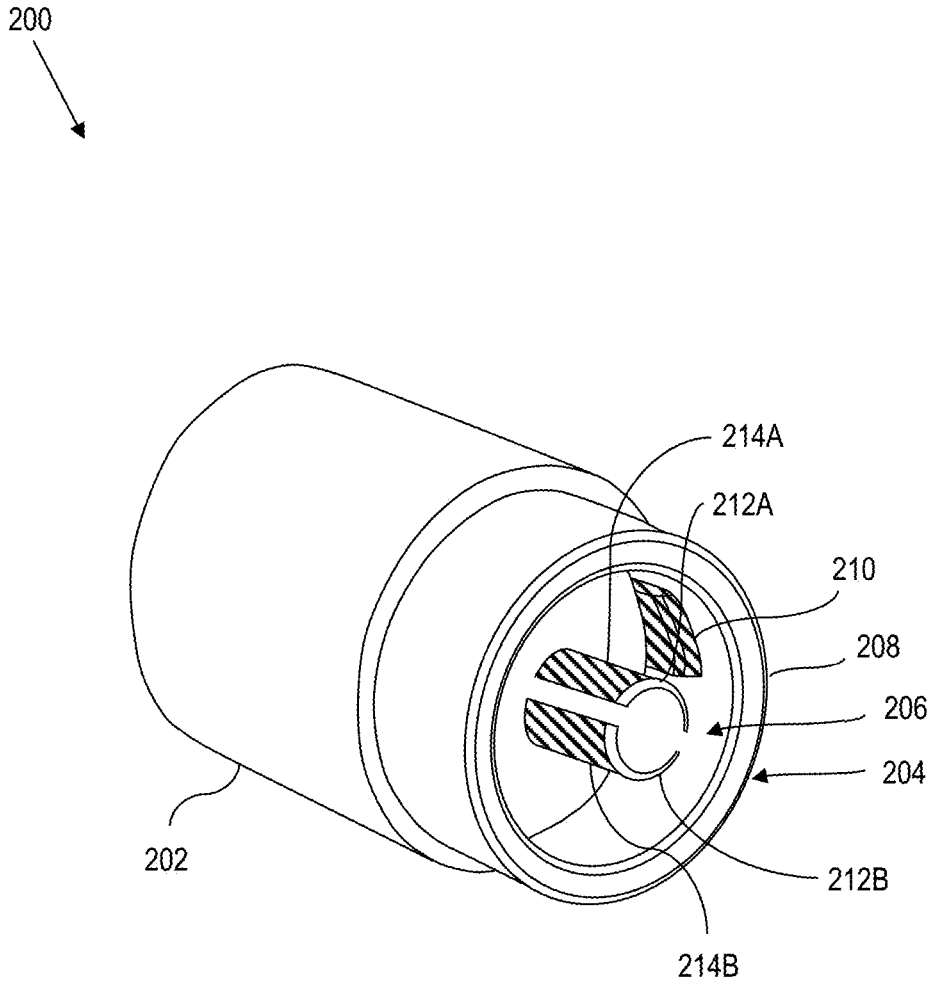
FIG. 2C illustrates another alternative embodiment of a second modular electrical connector end usable with a modular electrical distribution system.

Referring to FIG. 2C, another example embodiment of a second modular electrical connector end 200 is illustrated. The illustrated second modular electrical connector end 200 is similar to the second modular electrical connector end 200 of FIG. 2A unless otherwise noted. As such, like elements are illustrated with like reference numbers. Moreover, similar elements will not be described in detail. Rather, the disclosure with regard to similar elements to that of FIG. 2A is adopted by analogy. The second modular electrical connector end 200 of FIG. 2C is usable with a modular electrical distribution system, and can be utilized in cooperation with any of the first modular electrical connector end 100 (FIG. 1A-FIG. 1E).

Analogous to FIG. 2A, the illustrated second modular electrical connector end 200 includes a body 202 having an outer socket 204 and an inner plug 206. The outer socket 204 comprises an electrical contact, e.g., a electrical contact 210. Also, the inner plug 106 comprises an electrical contact, e.g., a electrical contact 214 positioned on an outside surface of an insulator 212.

However, the embodiment of FIG. 2C differs from the embodiment of FIG. 2A in that insulator 212 of FIG. 2A is replaced by insulator segments, illustrated by a first insulator segment 212A and a second insulator segment 212B. The electrical contact 214 is positioned on the first insulator segment 212A solely for clarity of illustration. In practice, there can be a electrical contact 214 on each insulator segment. Moreover, there can be more than two insulator segments.

The first insulator segment 212A is spaced from the second insulator segment 212B by a gap at each end. Thus, there is no annular ring formed like the tubular insulator 212 of FIG. 1A. Rather, the segments form spaced projections of non-conductive material. The use of insulator segments may be utilized, for instance, to provide a tolerance with regard to a mating component by allowing a "spring action" of the segments to create a solid mechanical coupling. In practice, there can be more segments than the first and second segments illustrated.

Figure 2D:
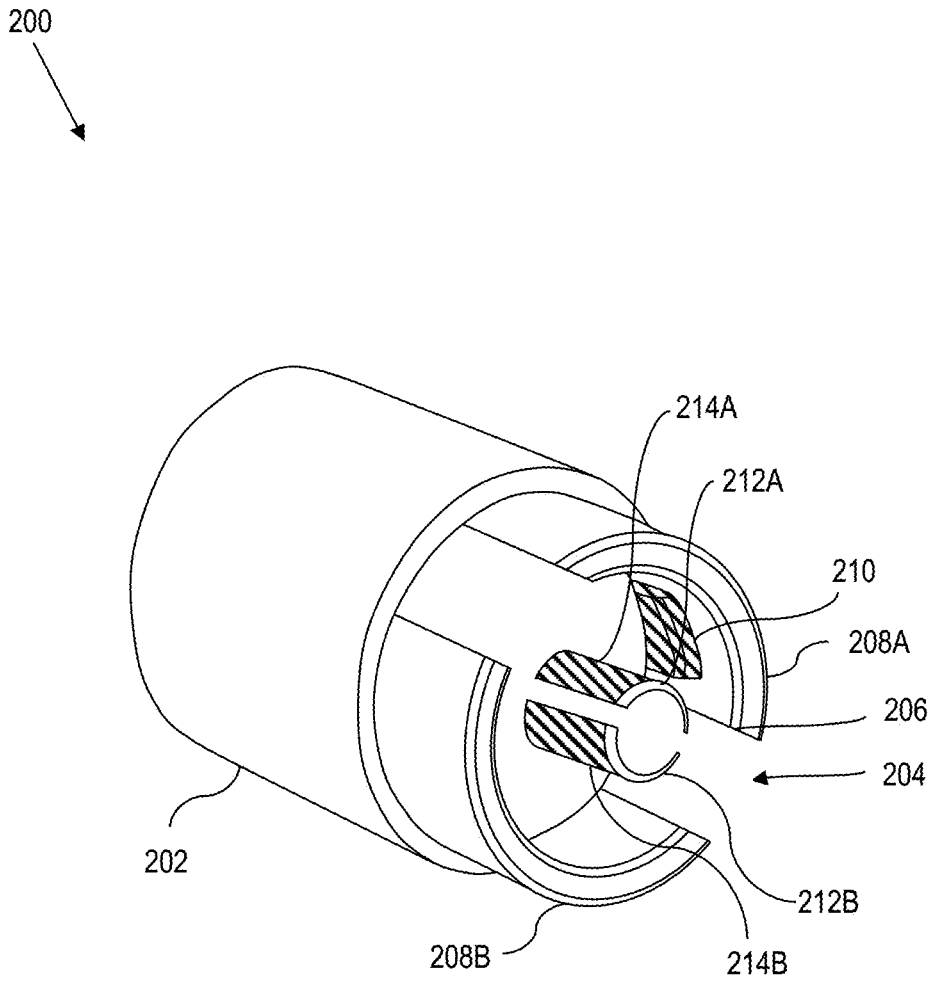
FIG. 2D illustrates yet another alternative embodiment of a second modular electrical connector end usable with a modular electrical distribution system.

Referring to FIG. 2D, yet another example embodiment of a second modular electrical connector end 200 is illustrated. The illustrated second modular electrical connector end 200 is similar to the second modular electrical connector end 200 of FIG. 2A unless otherwise noted. As such, like elements are illustrated with like reference numbers. Moreover, similar elements will not be described in detail. Rather, the disclosure with regard to similar elements to that of FIG. 2A is adopted by analogy. The second modular electrical connector end 200 of FIG. 2D is usable with a modular electrical distribution system, and can be utilized in cooperation with any of the first modular electrical connector end 100 (FIG. 1A-FIG. 1E).

Analogous to FIG. 2A, the illustrated second modular electrical connector end 200 includes a body 202 having an outer socket 204 and an inner plug 206. The outer socket 204 comprises an electrical contact, e.g., a electrical contact 210. Also, the inner plug 106 comprises an electrical contact, e.g., a electrical contact 214 positioned on an outside surface of an insulator 212.

However, the embodiment of FIG. 2D differs from the embodiment of FIG. 2A in that tubular insulator 208 of FIG. 2A is replaced by insulator segments, illustrated by a first insulator segment 208A and a second insulator segment 208B (analogous to FIG. 2B). The electrical contact 210 is positioned on the first insulator segment 208A solely for clarity of illustration. In practice, there can be a electrical contact 210 on each insulator segment. Moreover, there can be more than two insulator segments.

Also, the embodiment of FIG. 2D differs from the embodiment of FIG. 2A in that insulator 212 of FIG. 2A is replaced by insulator segments, illustrated by a first insulator segment 212A and a second insulator segment 212B (analogous to FIG. 2C). The electrical contact 214 is positioned on the first insulator segment 212A solely for clarity of illustration. In practice, there can be a electrical contact 214 on each insulator segment. Moreover, there can be more than two insulator segments.

Figure 2E:
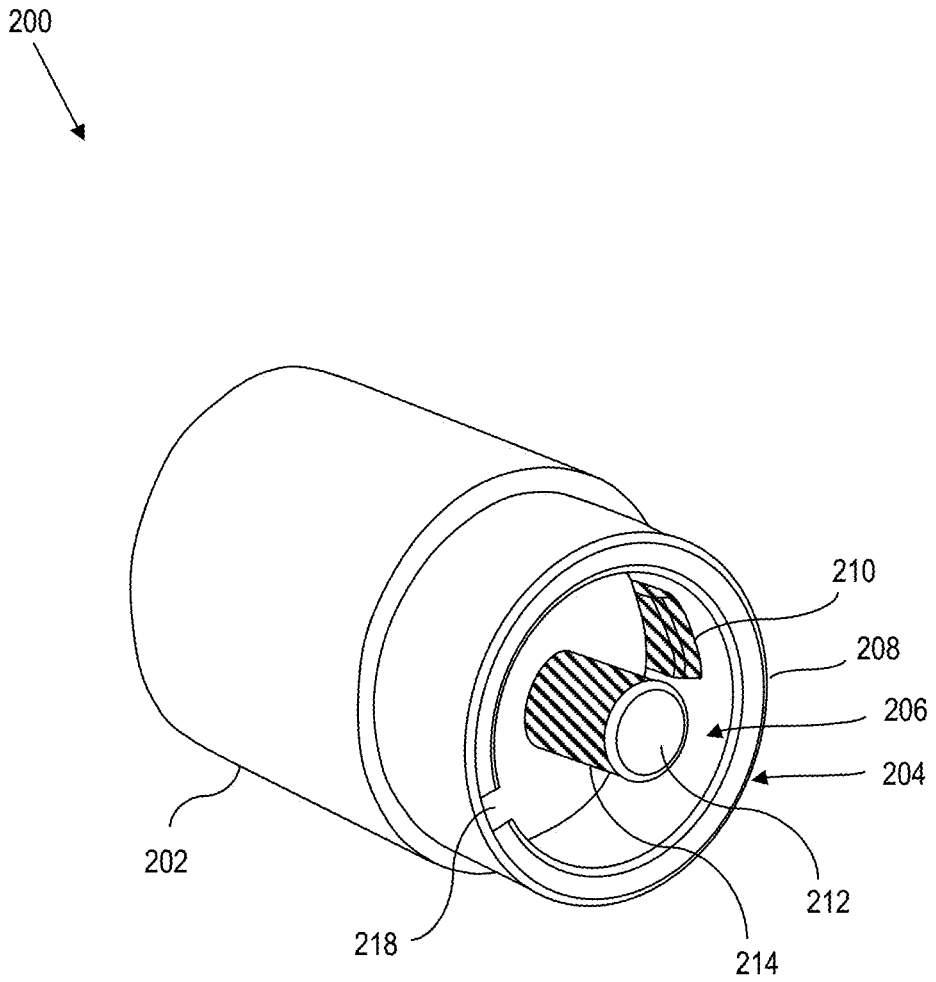
FIG. 2E illustrates still another alternative embodiment of a second modular electrical connector end usable with a modular electrical distribution system.

Referring to FIG. 2E, another example embodiment of a second modular electrical connector end 200 is illustrated. The illustrated second modular electrical connector end 200 is similar to the second modular electrical connector end 200 of FIG. 2A unless otherwise noted. As such, like elements are illustrated with like reference numbers. Moreover, similar elements will not be described in detail. Rather, the disclosure with regard to similar elements to that of FIG. 2A is adopted by analogy. The second modular electrical connector end 200 of FIG. 2E is usable with a modular electrical distribution system, and can be utilized in cooperation with any of the first modular electrical connector end 100 (FIG. 1A-FIG. 1E).

Analogous to FIG. 2A, the illustrated second modular electrical connector end 200 includes a body 202 having an outer socket 204 and an inner plug 206. The outer socket 204 comprises a tubular insulator 108 that supports an electrical contact, e.g., a electrical contact 210. Also, the inner plug 106 comprises an insulator 212 that supports an electrical contact, e.g., a electrical contact 214.

However, the embodiment of FIG. 2E differs from the embodiment of FIG. 2A in that tubular insulator 208 of FIG. 2E includes a key slot 218 that receives the key 118 (FIG. 1E).

Referring to FIG. 2A through 2E, any configuration can also alternatively include an outer wall, e.g., analogous to the tubular insulator 108 of FIG. 1A.

Distribution Connection

Figure 3:
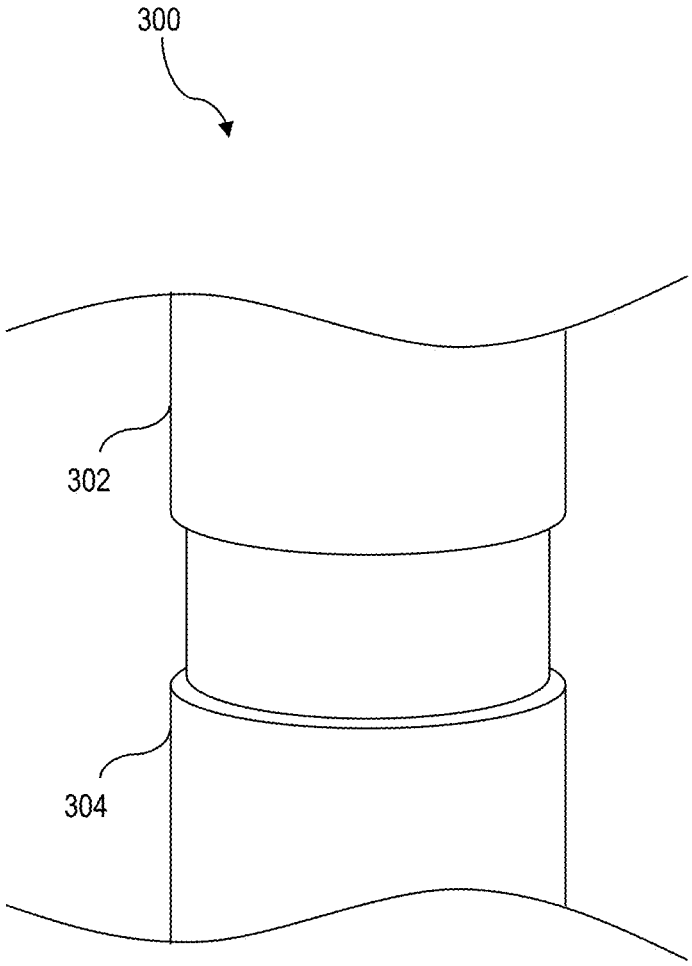
FIG. 3 illustrates a partial view of the first modular electrical connector end of FIG. 1 electrically connected to the second modular electrical connector end of FIG. 2A or FIG. 2B, according to aspects of the present disclosure.

FIG. 3 illustrates a partial view of a distribution connection 300. As illustrated, a first modular electrical connector end 302 (of a first cable assembly, not shown for conciseness) is electrically and mechanically connected to a second modular electrical connector end 304 (of a second cable assembly, not shown for conciseness).

By way of example, the first modular electrical connector end 302 can be implemented by any one of the first modular electrical connector end 100 described with reference to FIGS. 1A-1E. As such, the disclosure of FIGS. 1A-1E is incorporated herein and the details of the first modular electrical connector end 302 will not be further described.

Analogously, the second modular electrical connector end 304 can be implemented by any one of the second modular electrical connector end 200 described with reference to FIGS. 2A-2E. As such, the disclosure of FIGS. 2A-2E is also incorporated herein and the details of the second modular electrical connector end 304 will not be further described.

With reference to FIGS. 1A-3 generally, the inner plug 206 of the second modular electrical connector end 200 is received into the socket 104 of the first modular electrical connector end 100. More particularly, the electrical contact 214 on the outer surface of the tubular insulator 212 of the inner plug 206 makes direct and physical/mechanical contact with the electrical contact 110, e.g. conductive tab on the inside diameter of the tubular insulator 108 of the inner socket 104.

Notably, in some embodiments, either the electrical contact 214, the electrical contact 110 or both form a complete circle/annular ring such that the first modular electrical connector end 100 can be in any rotational orientation relative to the second modular electrical connector end 200 and can still maintain electrical contact. In other embodiments, one or both of the electrical contact 214 and the electrical contact 110 do not form a complete circle/annular ring such that the first modular electrical connector end 100 must be rotated into a proper rotational orientation relative to the second modular electrical connector end 200 to form an electrical contact. Here, there can be one or more discrete rotational positions where electrical contact is formed. For example, the electrical contact 214 can have one or more breaks so as to define discrete conductive positions, any one of which can be rotated into contact with the electrical contact 110. Other configurations can alternatively be implemented.

Likewise, the outer plug 106 of the first modular electrical connector end is received into the outer socket 204 of the second modular electrical connector end 200. More particularly, the electrical contact 114 on the outside surface of the tubular insulator 108 of the outer plug 106 makes direct and physical/mechanical contact with the electrical contact 210 on the inside diameter of the tubular insulator 208 of the outer socket 204.

Analogous to that above, in some embodiments, either the electrical contact 114, the electrical contact 210 or both form a complete circle/annular ring such that the first modular electrical connector end 100 can be in any rotational orientation relative to the second modular electrical connector end 200 and can still maintain electrical contact. In other embodiments, one or both of the electrical contact 114 and the electrical contact 210 do not form a complete circle/annular ring such that the first modular electrical connector end 100 must be rotated into a proper rotational orientation relative to the second modular electrical connector end 200 to form an electrical contact. Here, there can be one or more discrete rotational positions where electrical contact is formed. For example, the electrical contact 114 can have one or more breaks so as to define discrete conductive positions, any one of which can be rotated into contact with the electrical contact 110. Other configurations can alternatively be implemented.

Notably, in some embodiments, e.g., the embodiment of FIG. 1A, the first modular electrical connector end 100 includes an outer wall 116, which is an insulative outer ring. Where provided, this outer wall 116 forms a mechanical fit with the outer wall of the tubular insulator 208. This is not strictly required, but may be provided, for example, to create added mechanical coupling of the first modular electrical connector end 100 to the modular electrical connector end 200.

Cable Assembly

Figure 4A:
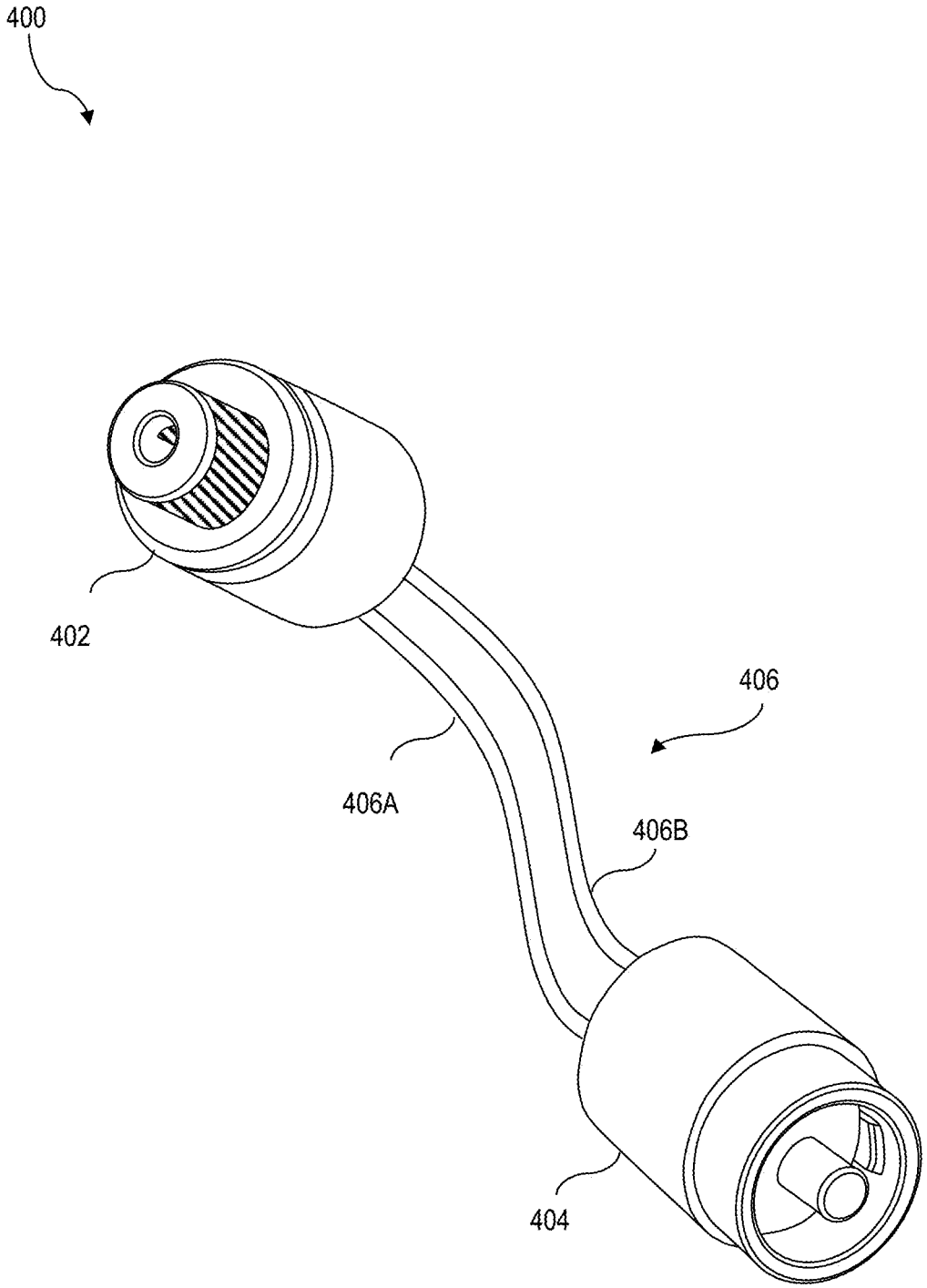
FIG. 4A illustrates an example electrical cable that can form part of a modular electrical distribution system, the electrical cable including a first modular electrical connector end and a second modular electrical connector end, according to aspects of the present disclosure.

Referring now to FIG. 4A, an electrical cable 400 is illustrated according to aspects of the present disclosure. The illustrated electrical cable 400 can form part of a modular electrical distribution system. In this regard, the electrical cable 400 includes a first modular electrical connector end 402, a second modular electrical connector end 404, and a wire bundle 406 that forms an electrical connection between the first modular electrical connector end 402 and the second modular electrical connector end 404.

By way of example, the first modular electrical connector end 402 can be implemented by any one of the first modular electrical connector end 100 described with reference to FIGS. 1A-1E. As such, the disclosure of FIGS. 1A-1E is incorporated herein and the details of the first modular electrical connector end 402 will not be further described.

Analogously, the second modular electrical connector end 404 can be implemented by any one of the second modular electrical connector end 200 described with reference to FIGS. 2A-2E. As such, the disclosure of FIGS. 2A-2E is incorporated herein and the details of the second modular electrical connector end 404 will not be further described.

As noted above, the wire bundle 406 forms an electrical connection between the first modular electrical connector end 402 and the second modular electrical connector end 404. With reference briefly to FIGS. 1A-4A, in the illustrated example, the first modular electrical connector end 402 and the second modular electrical connector end 404 each include a single plug and a single socket. In this regard, the wire bundle 406 includes a first wire 406A that electrically connects the conductive tab of the inner socket (e.g., see the electrical contact 110 illustrated as a conductive tab of the inner socket 104 of the first modular electrical connector end 100 (FIGS. 1A-1E) of the first modular electrical connector end 402 to the conductive material on the inner plug of the second modular electrical connector end 404 (e.g., electrical contact 214 of the inner plug 206 of the second modular electrical connector end 200, FIGS. 2A-2E).

The wire bundle 406 also includes a second wire 406B that electrically connects the conductive tab of the outer socket of the second modular electrical connector end 404 (e.g., the electrical contact 210 of the outer socket 204 of the second modular electrical connector end 200, FIGS. 2A-2E) to the conductive material on the outer plug of the first modular electrical connector end 402 (e.g., electrical contact 114 of the outer plug 106 of the first modular electrical connector end 100, FIGS. 1A-1E).

In this regard, wire, conductive material, and conductive tab configurations are selected for the power requirements of the device. For instance, in some embodiments, the electrical cable 400 passes 120 VAC. In other embodiments, e.g., where light emitting diode (LED) lighting is provided, the electrical cable 400 may pass 12 VDC, 5 VDC or other suitable voltage, as dictated by the lighting requirements.

As such, a series of electrical cables 400 can be strung together to form a modular electrical distribution system by plugging the second modular electrical connector end 404 of a first electrical cable 400 into a corresponding first modular electrical connector end 402 of a second electrical cable 400, or vice-versa. This process can be repeated for as many cables as desired.

Figure 4B:
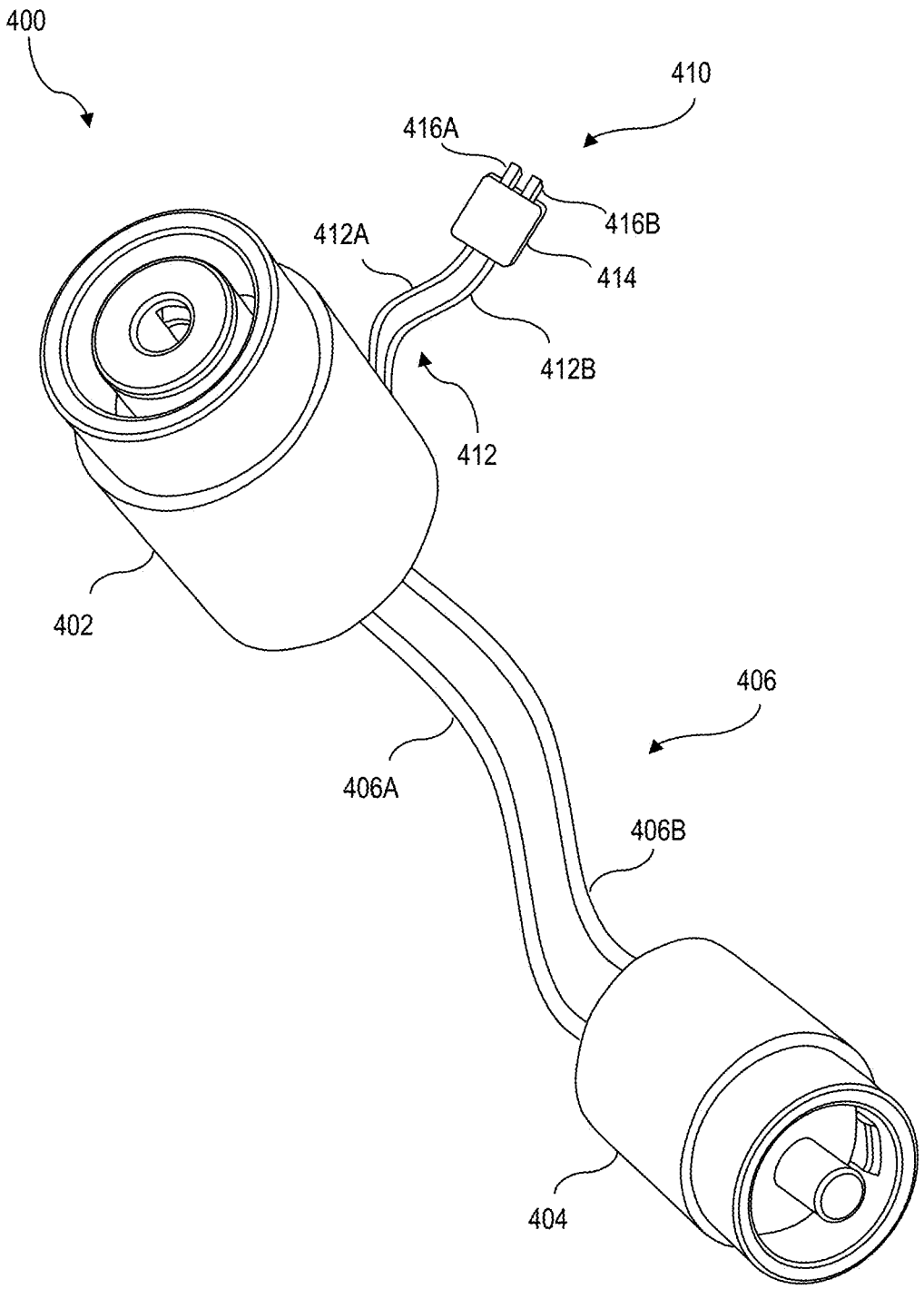
FIG. 4B illustrates an example electrical cable that can form part of a modular electrical distribution system, the electrical cable including a first modular electrical connector end, a second modular electrical connector end, and a power cord extending therefrom, according to aspects of the present disclosure.

With reference to FIG. 4B, an electrical cable 400 is illustrated, which is analogous to the electrical cable 400 of FIG. 4A. As such, like structure is illustrated with like reference numbers. Since like elements are included, only differences are discussed in detail. Notably, the electrical cable 400 of FIG. 4B is identical to the electrical cable 400 of FIG. 4A, except that the electrical cable 400 of FIG. 4B also includes a courtesy extension cable 410 that extends therefrom. The courtesy extension cable 410 includes a first extension wire 412A, a second extension wire 412B, and an electrical connector 414 Here, the extension wire 412A is electrically connected to the first wire 406A, and the second extension wire 412B is electrically connected to the second wire 406B. The electrical connector 414 is any coupling means to attach power to a light or other powered device. For instance, the electrical connector 414 can be implemented as a conventional AC (alternating current) plug, such as a dual blade configuration, where a first blade is a conductive blade 416A that is electrically connected to the first extension wire 412A, and hence is electrically connected to the first wire 406A. Analogously, the second blade is a conductive blade 414B that is electrically connected to the second extension wire 412B, and is hence, electrically connected to the second wire 406B. In alternative embodiments, the electrical connector 414 can be an outlet or other configuration.

In practical applications, the courtesy extension cable 410 can be electrically and/or mechanically coupled to the electrical cable 400 in any practical location, including the first modular electrical connector end 402, the second modular electrical connector end 404, anywhere along the length of the wire bundle 406, etc. Moreover, there can be more than one courtesy extension cable 410, each courtesy extension cable 410 anywhere on the electrical cable 400.

Figure 4C:
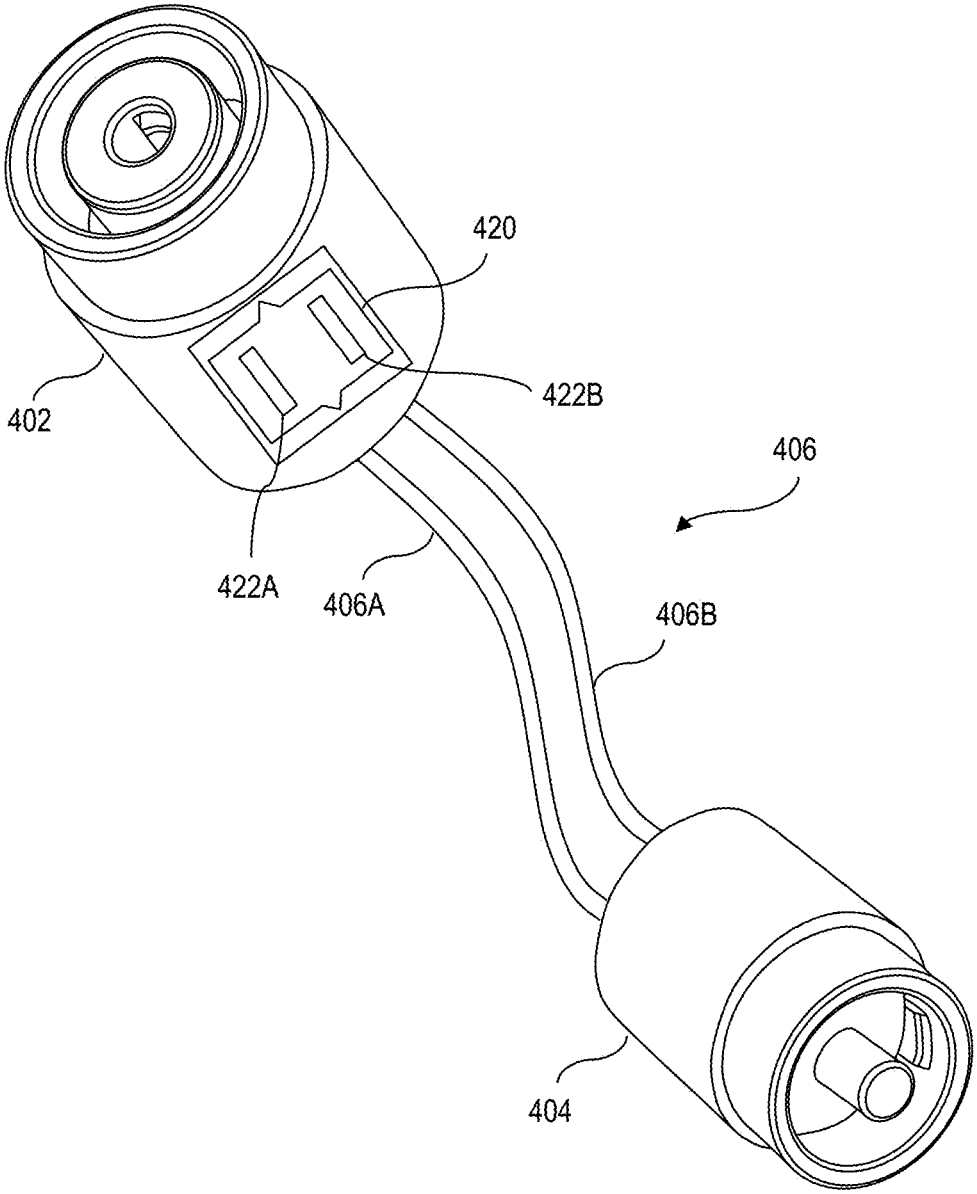
FIG. 4C illustrates an example electrical cable that can form part of a modular electrical distribution system, the electrical cable including a first modular electrical connector end, a second modular electrical connector end, and a power outlet, according to aspects of the present disclosure.

With reference to FIG. 4C, an electrical cable 400 is illustrated, which is analogous to the electrical cable 400 of FIG. 4A. As such, like structure is illustrated with like reference numbers. Since like elements are included, only differences are discussed in detail. Notably, the electrical cable 400 of FIG. 4C is identical to the electrical cable 400 of FIG. 4A, except that the electrical cable 400 of FIG. 4C also includes a courtesy outlet 420. The courtesy outlet 420 includes an electrical socket having a first socket connector 422A and a second socket connector 422B. Here, the first socket connector 422A includes a conductive portion that is electrically connected to the first wire 406A, and the second socket connector 422B includes a conductive portion that is electrically connected to the second wire 406B. The electrical socket is any socket configuration, and can include a conventional AC (alternating current) socket.

In practical applications, the courtesy outlet 420 can be electrically and/or mechanically coupled to the cable in any practical location, including the first modular electrical connector end 402, the second modular electrical connector end 404, anywhere along the length of the wire bundle 406, etc. Moreover, there can be more than one courtesy outlet 420, each courtesy outlet 420 anywhere on the electrical cable 400.

With reference to FIG. 4A, FIG. 4B, and FIG. 4C generally, as illustrated, the wire bundle 406 is illustrated with two wires. In practice, the wire bundle 406 can support multiple wires, e.g., to create multiple discrete circuits. Here, each courtesy extension cable 410 (e.g., as illustrated in FIG. 4B) and/or courtesy outlet 420 (e.g., as illustrated in FIG. 4C) can connect to the same or different circuit. Here, the number of necessary wires can depend upon the number of plugs and corresponding sockets provided on the body of the electrical connector ends.

First Modular Electrical Connector End with Parallel Circuits

Figure 5:
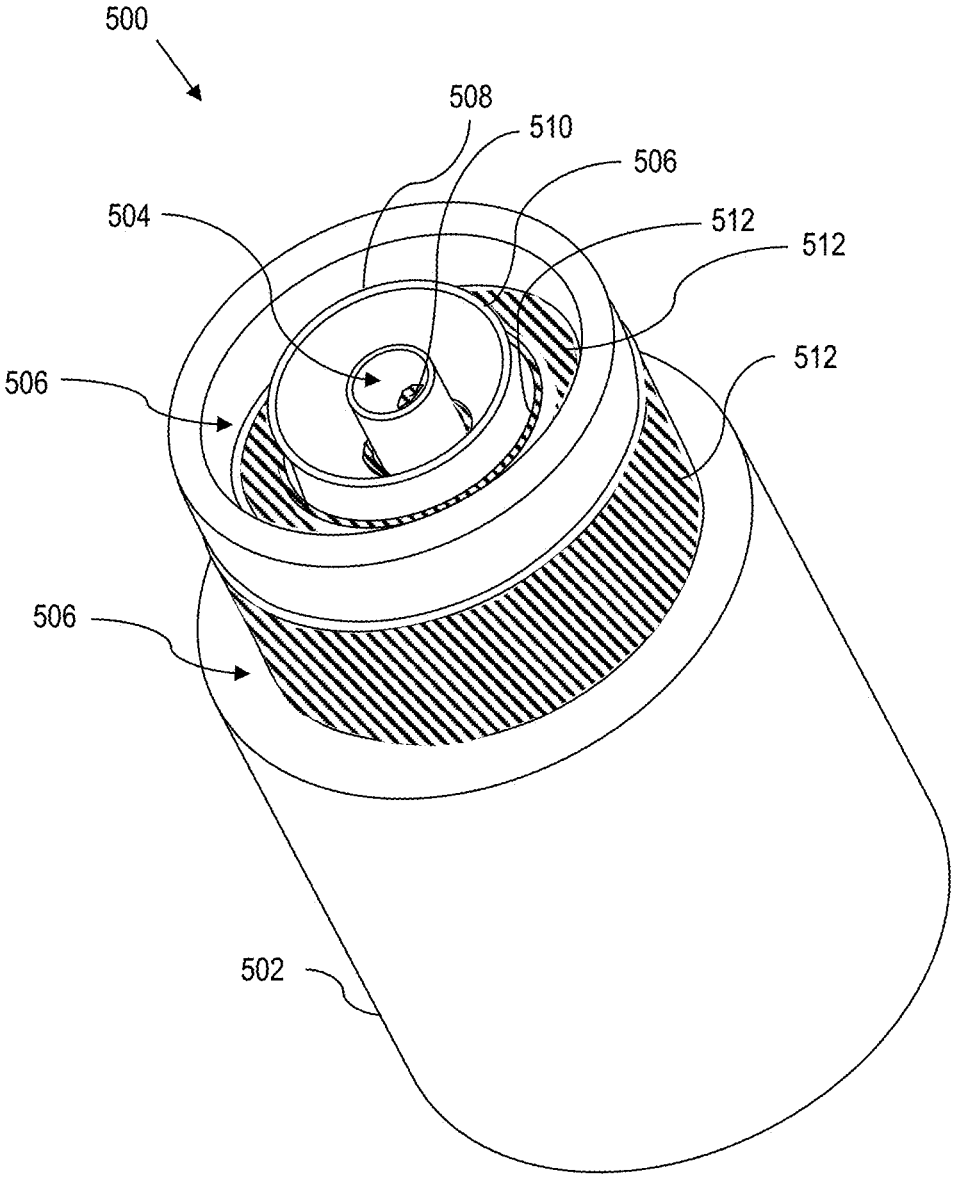
FIG. 5 illustrates another example modular electrical connector end usable with a modular electrical distribution system, according to aspects herein.

Referring to FIG. 5, another example modular electrical connector end 500 is illustrated. The modular electrical connector end 500 is usable with a modular electrical distribution system, described more fully herein.

The modular electrical connector end 500 is largely analogous to the first modular electrical connector end 100 of FIGS. 1A-1E. As such, like elements are illustrated with like reference numbers 400 higher. Moreover, the description of FIGS. 1A-1E is incorporated into the modular electrical connector end 500. As such, for sake of conciseness, only differences are discussed in detail.

The example first modular electrical connector end 500 includes in general, a body 502 that houses an inner socket 504 and a plurality of outer plugs 506 that all at least partially circumscribe the inner socket 504.

The inner socket 504 of the first modular electrical connector end 500 is defined by an interior of a tubular insulator 508. For instance, as illustrated, a tubular insulator 508 is illustrated as having an inside diameter that defines a cross-section of a hollow of the tubular insulator 508. The inside diameter, along with the depth of the hollow, thus form a receptacle for the inner socket 504. The inner socket 504 comprises a conductive tab 510 on an inside surface thereof. The conductive tab 510 can comprise for example, a flat metal pad, a metal having a spring characteristic, etc. As will be described in greater detail herein, the conductive tab 510 facilitates an electrical connection to a wire of the modular electrical distribution system.

The outer plugs 506 of the first modular electrical connector end 500 are defined by surfaces of one or more insulators (e.g., tubular insulators, insulator segments, etc.) that project from the body 102. Here, so long as the insulator forms a projection from the body 502, a corresponding outer plug 506 can be on the inside surface or outside surface. Regardless, each plug is defined by an electrical contact 512, thus defining the conductor of the outer plug 506. As described in greater detail herein, the electrical contact 512 of each outer plug 506 facilitates an electrical connection to a corresponding wire of the modular electrical distribution system, and can comprise any structure, e.g., analogous to the electrical contact 110, electrical contact 114 (FIGS. 1A-1E), electrical contact 210, electrical contact 214 (FIGS. 2A-2E), combinations thereof, etc.

Second Modular Electrical Connector End with Parallel Circuits

Figure 6:
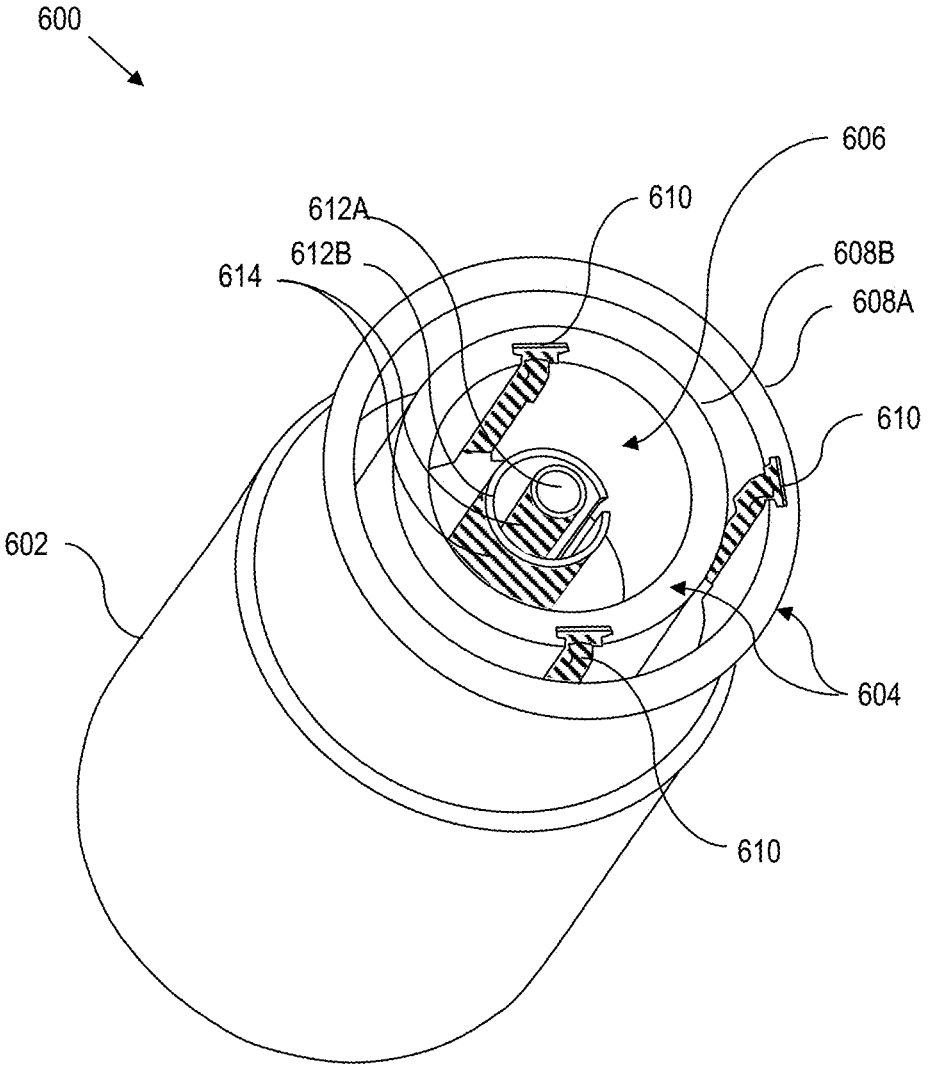
FIG. 6 illustrates yet another example modular electrical connector end usable with a modular electrical distribution system, according to aspects herein.

Referring to FIG. 6, another example modular electrical connector end 600 is illustrated. The modular electrical connector end 600 is usable with a modular electrical distribution system, described more fully herein, and is particularly suited for use with the modular electrical connector end 500 (FIG. 5).

The modular electrical connector end 600 is largely analogous to the second modular electrical connector end 200 of FIGS. 2A-2E. As such, like elements are illustrated with like reference numbers 400 higher. Moreover, the description of FIGS. 2A-2E are incorporated into the modular electrical connector end 600. As such, for sake of conciseness, only differences are discussed in detail.

The example second modular electrical connector end 600 includes in general, a body 602 that houses a plurality of outer sockets 604 and one or more inner plugs 606, where the outer sockets 604 all circumscribe the inner plug(s) 606.

Each outer socket 604 of the second modular electrical connector end 600 is defined by volume formed by one or more corresponding insulators. For instance, as illustrated, a first insulator 608A at least partially circumscribes and is spaced outwardly from a second insulator 608B. As such, a receptable is defined by the gap between an inside major surface of the first insulator 608A and an outside major surface of the second insulator 608B. This provides an opportunity to accommodate two or more plugs into the same void.

Each outer socket 604 comprises an electrical contact 610. The electrical contact 610 can comprise any structure, e.g., analogous to the electrical contact 110, electrical contact 114 (FIGS. 1A-1E), electrical contact 210, electrical contact 214 (FIGS. 2A-2E), combinations thereof, etc. As will be described in greater detail herein, each electrical contact 610 facilitates an electrical connection to a corresponding wire of the modular electrical distribution system. Because of the thickness of the second insulator 608B, one or more electrical contacts 610 can positioned on an outside major surface thereof, and one or more electrical contacts 610 can be positioned on an inside major surface thereof.

The inner plug(s) 606 of the second modular electrical connector end 600 is/are defined by an exterior surface of an insulator that projects from the housing 602. For instance, as illustrated, the insulator 612A is illustrated as having an outside surface that projects from the housing 602, thus exposing an outside surface. The outside surface includes an electrical contact 614, e.g., is covered with a conductive material, thus defining the conductor of a first plug 606. In practice, the electrical contact 614 can comprise any structure, e.g., as analogous to the electrical contact 110, electrical contact 114 (FIGS. 1A-1E), electrical contact 210, electrical contact 214 (FIGS. 2A-2E), combinations thereof, etc. Analogously, an insulator 612B is illustrated as having an outside surface that projects from the housing 602 (e.g., at least partially circumscribing the insulator 612A), thus exposing an outside surface. The outside surface is covered with a electrical contact 614, thus defining the conductor of a second plug 606. As described in greater detail herein, the electrical contact 614 of the plugs 606 and the electrical contact 610 of the sockets 604 facilitate corresponding electrical connections to associated wires of the modular electrical distribution system.

Referring to FIG. 5 and FIG. 6 taken together, the first modular electrical connector end 500 and the second modular electrical connector end 600 support four parallel circuits, and are formed as mating connectors. Thus, a cable bundle formed in an electrical cable including the first modular electrical connector end 500 and the second modular electrical connector end 600 would include a minimum of five wires, including four signal carrying wires and a common ground. In other applications, each wire can carry its own ground, or multiple wires can be provided per circuit. For instance, where color changing LEDs are used, each circuit can carry five or more wires, such as two wires for power, and three wires for sending control signals such as to control a reg, green, blue (RGB) controller of an LED string. A wire may also be provided for a white LED, etc. In example applications, the number of wires per circuit will depend upon the illumination requirements of a corresponding decoration. In this regard, the modular distribution system can adapt to handle a variety of illumination requirements, e.g., by changing the number of electrical connector on the modular electrical connector ends and associated number of wires.

Example Illuminable Artificial Tree

An example application is an illuminable decoration such as an artificial tree. The artificial tree includes trunk section formed by hollow tubes that stack together to form a "trunk" of the artificial tree. An electrical cable is installed within each trunk section. In this regard, when the trunk sections are assembled together, power can be passed up the truck.

Figure 7:
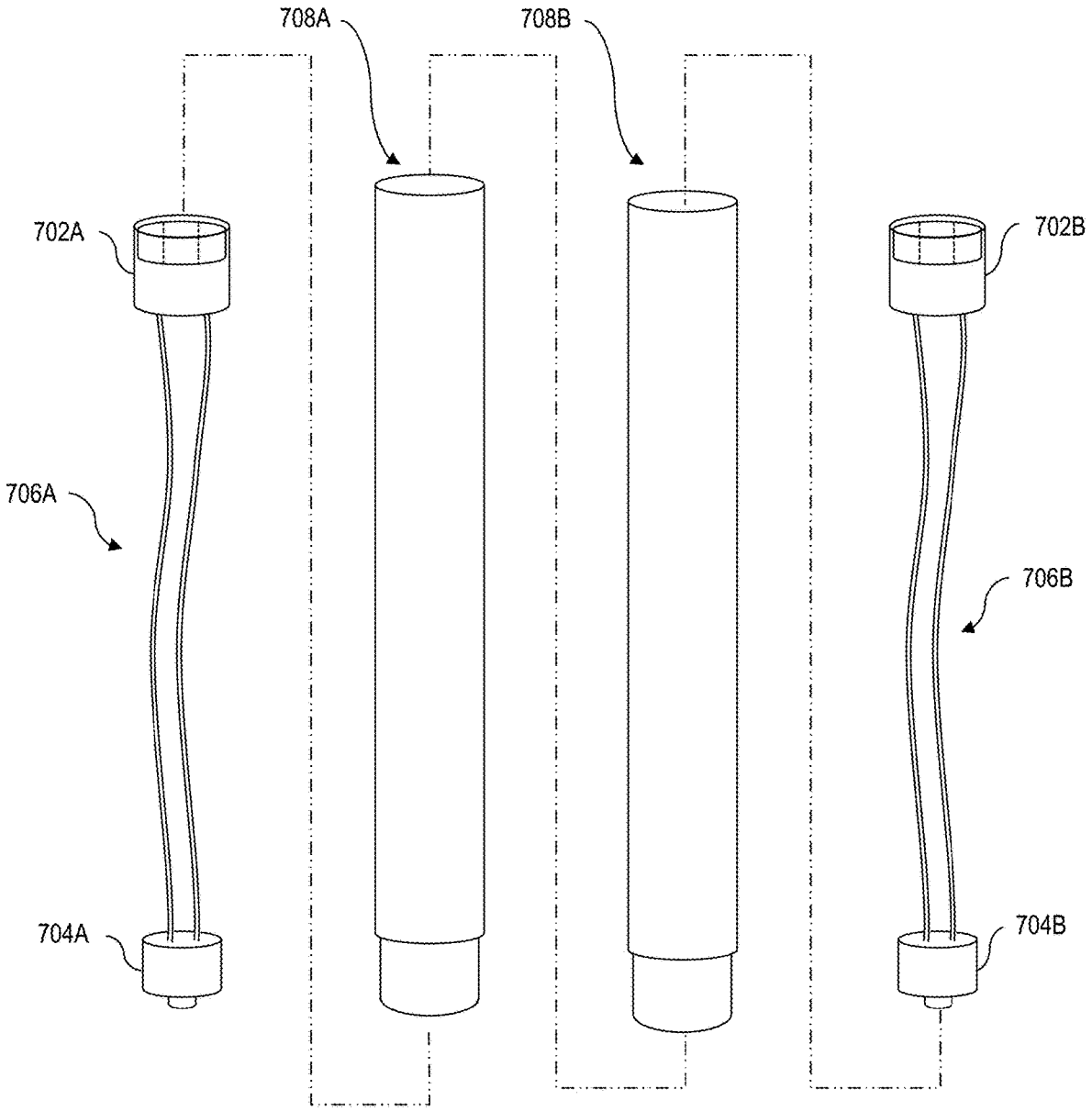
FIG. 7 illustrates an exploded view showing that a first electrical cable is installed into a first trunk section of an illuminable decoration such as an artificial tree, a second electrical cable is installed into a second trunk section of the decoration, and when connected, the first trunk section mechanically couples to the second trunk section, and the first electrical cable mechanically and electrically couples to the second electrical cable, according to aspects of the present disclosure.

Referring to FIG. 7, an exploded view shows that a first electrical cable 700A includes a first modular electrical connector end 702A, a second modular electrical connector end 704A, and a wire bundle 706A that forms an electrical connection between the first modular electrical connector end 702A and the second modular electrical connector end 704A. Here, the electrical cable 700A can be analogous to the electrical cable 400 (e.g., any embodiment shown in FIGS. 4A-4C) and/or include a cable assembly that includes any of the modular connector ends of other features, capabilities, etc., described more fully herein with reference to FIGS. 1A-6. The first electrical cable 700A is installed inside a hollow of a first trunk section 708A. For instance, the first modular electrical connector end 702A can be analogous to the first modular electrical connector end 100 (FIGS. 1A-1E), the first modular electrical connector end 500 (FIG. 5) or other suitable configuration. Similarly, the second modular electrical connector end 704A can be analogous to the second modular electrical connector end 200 (FIGS. 2A-2E), the second modular electrical connector end 600 (FIG. 6) or other suitable configuration.

Analogously, a second electrical cable 700B includes a first modular electrical connector end 702B, a second modular electrical connector end 704B, and a wire bundle 706B that forms an electrical connection between the first modular electrical connector end 702B and the second modular electrical connector end 704B. Here, the electrical cable 700B can be analogous to the electrical cable 400 (e.g., any embodiment shown in FIGS. 4A-4C) and/or include a cable assembly that includes any of the modular connector ends of other features, capabilities, etc., described more fully herein with reference to FIGS. 1A-6. The second electrical cable 700B is installed inside a hollow of a second trunk section 708B. For instance, the first modular electrical connector end 702B can be analogous to the first modular electrical connector end 100 (FIGS. 1A-1E), the first modular electrical connector end 500 (FIG. 5) or other suitable configuration. Similarly, the second modular electrical connector end 704B can be analogous to the second modular electrical connector end 200 (FIGS. 2A-2E), the second modular electrical connector end 600 (FIG. 6) or other suitable configuration.

Although only two trunk sections 708A and 708B are illustrated for sake of conciseness, in practice the artificial tree can include as many trunk sections as is necessary to define an overall height of the artificial tree. Notably, a first electrical cable is installed into a first trunk section of a decoration such as an artificial tree, a second electrical cable is installed into a second trunk section of the decoration, etc. Moreover, in some embodiments, when the trunk sections are connected, the first trunk section mechanically couples to the second trunk section, and the first electrical cable mechanically and electrically couples to the second electrical cable.

In some embodiments, the cable ends are positioned in the respective trunk sections such that no step is required to make the electrical connection beyond mechanically connecting the respective trunk sections. That is, as a second trunk section is slid axially into a first trunk section, a corresponding second modular electrical connector end of the second trunk section simultaneously and automatically connects (e.g., mechanically and electrically) to a first modular electrical connector end of the first trunk section. Thus, a modular electrical distribution system is automatically built (both mechanically and electrically) as trunk sections are mechanically connected to form a trunk.

Another Example Trunk Section Connection

Figure 8A:
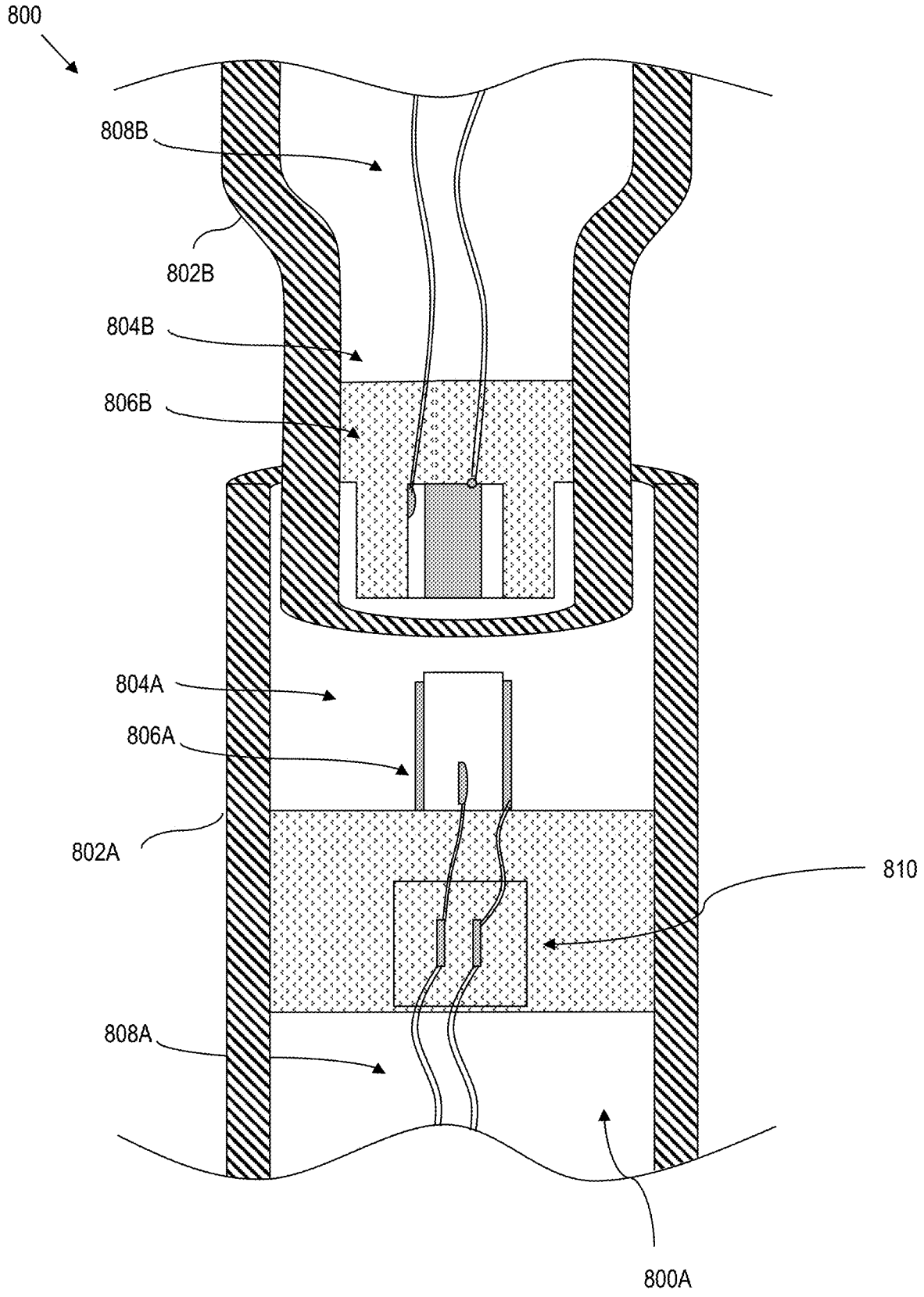
FIG. 8A illustrates a schematic cross-section of an example trunk connection showing a first trunk section of an illuminable decoration mechanically coupled to a second trunk section, and a first electrical cable mechanically and electrically coupled to a second electrical cable, according to aspects of the present disclosure.

FIG. 8A illustrates a schematic cross-section of an example trunk connection showing a first trunk section 802A mechanically coupling to a second trunk section 802B, and a first electrical cable 804A mechanically and electrically coupling to a second electrical cable 804B, according to aspects of the present disclosure. In general, FIG. 8A illustrates partial views of the first trunk section 802A, the second trunk section 802B, first electrical cable 804A, and second electrical cable 804B for convenience of illustration and discussion.

The second trunk section 802B is illustrated sliding downward axially onto the first trunk section 802A. When the second trunk section 802B is inserted into the first trunk section 802A, the mechanical coupling of the trunk sections simultaneously and automatically forms the electrical connections between the first electrical cable 804A and second electrical cable 804B as described more fully herein.

The first electrical cable 804A includes a first modular electrical connector end 806A. A second modular electrical connector end is not illustrated for conciseness of discussion herein. However, a wire bundle 808A forms an electrical connection between the first modular electrical connector end 806A and the second modular electrical connector end (not shown). Here, the electrical cable 804A is be analogous to the electrical cable 400 (any embodiment of FIGS. 4A-4C); electrical cable 706A, 706B (FIG. 7) and/or can include a cable assembly that includes any of the modular connector ends of other features, capabilities, etc., described more fully herein, e.g., with reference to FIG. 1A—FIG. 7. The first electrical cable 804A is installed inside a hollow of a first trunk section 802A. In this embodiment, the first modular electrical connector end 806A can be analogous to the first modular electrical connector end 100 (any embodiment in FIGS. 1A-1E), the first modular electrical connector end 500 (FIG. 5) or other suitable configuration. Similarly, the second modular electrical connector end (not shown) can be analogous to the second modular electrical connector end 200 (any embodiment in FIGS. 2A-2E), the second modular electrical connector end 600 (FIG. 6) or other suitable configuration.

Analogously, the second electrical cable 804B includes a first modular electrical connector end (not shown for conciseness), a second modular electrical connector end 806B, and a wire bundle 808B that forms an electrical connection between the first modular electrical connector end and the second modular electrical connector end 806B. Here, the electrical cable 804B can be analogous to the electrical cable 400 (FIGS. 4A-4C); electrical cable 706A, 706B (FIG. 7) and/or include a cable assembly that includes any of the modular connector ends of other features, capabilities, etc., described more fully herein with reference to FIGS. 1A-7. Analogous to the first electrical cable 804A, the first modular electrical connector end (not shown) can be analogous to the first modular electrical connector end 100 (any embodiment in FIGS. 1A-1E), the first modular electrical connector end 500 (FIG. 5) or other suitable configuration. Similarly, the second modular electrical connector end 806B can be analogous to the second modular electrical connector end 200 (any embodiment in FIGS. 2A-2E), the second modular electrical connector end 600 (FIG. 6) or other suitable configuration.

Also illustrated in FIG. 8A, at least one of the cable ends includes additional distribution capability. For instance, as illustrated, the second electrical cable 800B includes a outlet 810. The outlet 810 can be exposed through the outside surface of the corresponding trunk section 802A. The outlet 810 can be used to plug in lights, e.g., lights wrapped around branches of the trunk section 802A.

In FIG. 8A, conductive elements are illustrated in solid fill and are connected by conductive wires. Insulative material is illustrated by hatched shading. The electrical connections are analogous to those described with reference to FIGS. 1A-7.

Figure 8B:
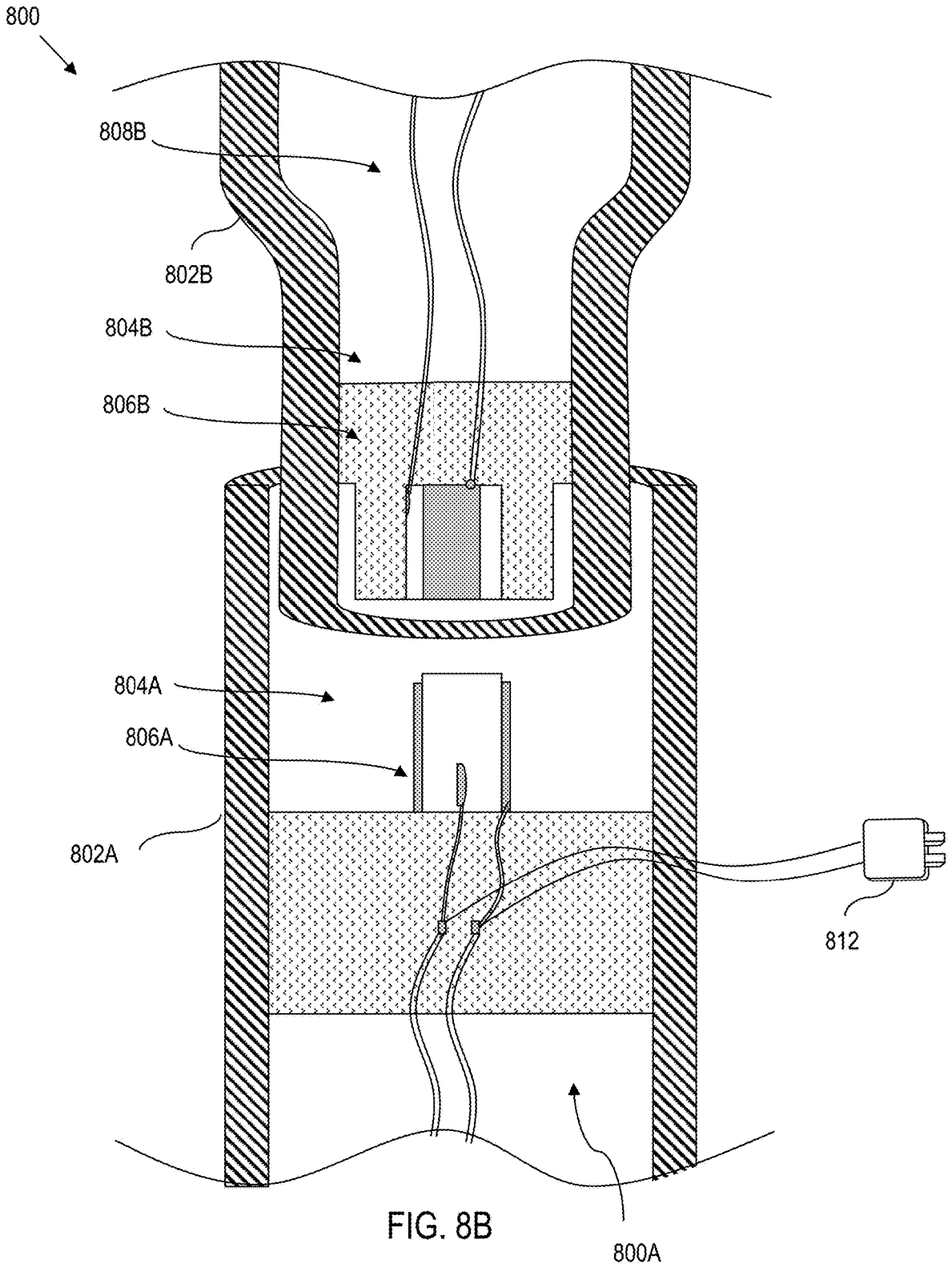
FIG. 8B illustrates another example schematic cross-section of an example trunk connection showing a first trunk section of an illuminable decoration mechanically coupled to a second trunk section, and a first electrical cable mechanically and electrically coupled to a second electrical cable, according to aspects of the present disclosure.

Referring now to FIG. 8B, a schematic cross-section of another example trunk connection is illustrated, showing a first trunk section 802A mechanically coupling to a second trunk section 802B, and a first electrical cable 804A mechanically and electrically coupling to a second electrical cable 804B, according to aspects of the present disclosure. In general, FIG. 8B is analogous to that of FIG. 8A, and as such, like structure is illustrated with like reference numbers. Therefore, only differences will be discussed. As illustrated, FIG. 8B includes a courtesy extension cable 812 rather than an outlet 810 of FIG. 8A. Thus, by way of comparison, in FIG. 8B, the first electrical cable 804A can be implemented by the cable 400 of FIG. 4B. Analogously, the first electrical cable 804A in FIG. 8A can be implemented by the cable 400 of FIG. 4C. The extension cable 812 can be used to plug in string lights or other items requiring electrical power.

Figure 9:
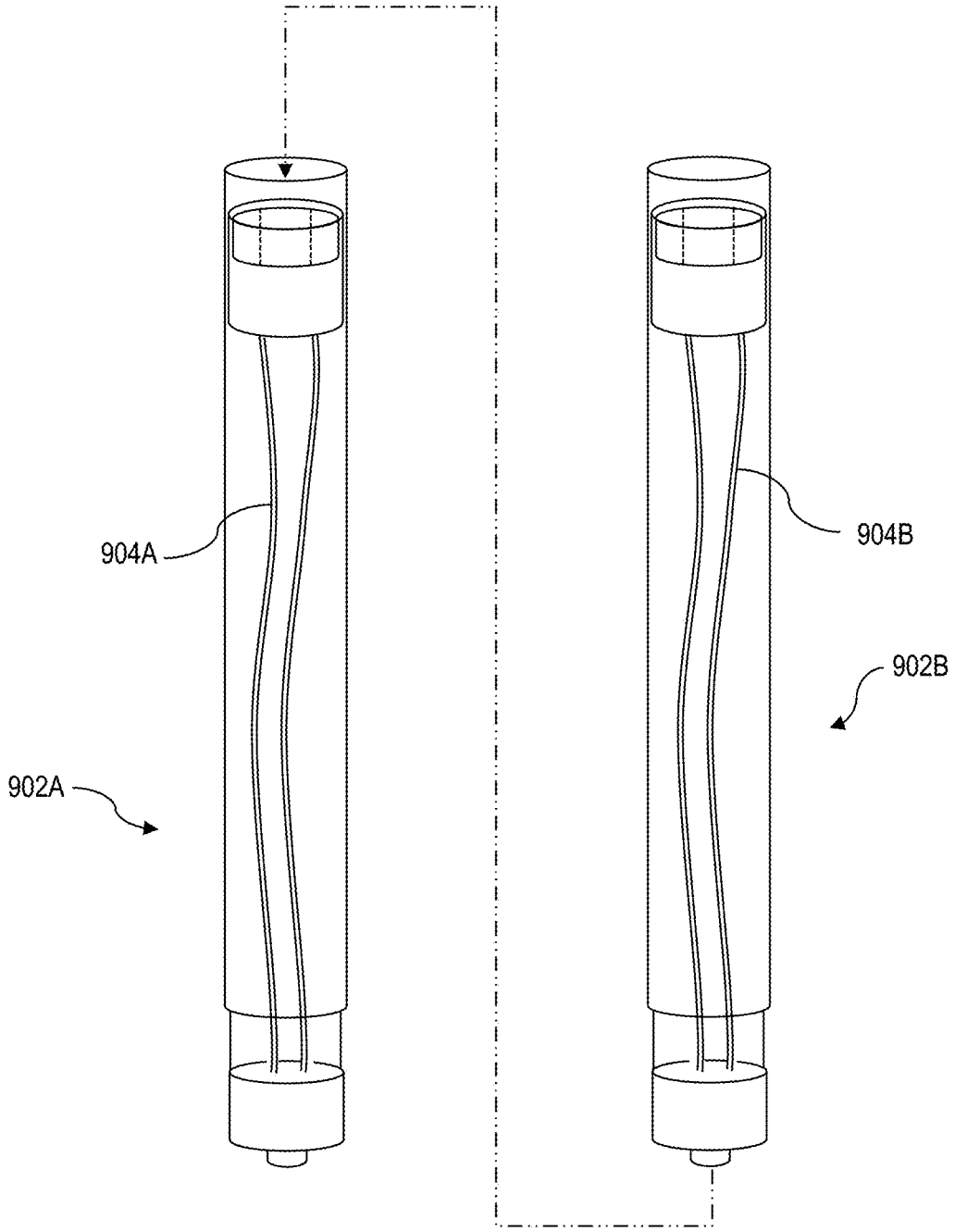
FIG. 9 illustrates an exploded view showing that a first electrical cable is installed into a first trunk section of an illuminable decoration such as an artificial tree, a second electrical cable is installed into a second trunk section of the decoration, and when connected, the first trunk section mechanically couples to the second trunk section, and the first electrical cable mechanically and electrically couples to the second electrical cable, according to aspects of the present disclosure.

Referring to FIG. 9, a schematic cross-section of an example trunk connection illustrates a first trunk section 902A mechanically couplable to a second trunk section 902B, and a first electrical cable 904A mechanically and electrically coupled to a second electrical cable 904B, according to aspects of the present disclosure. In general, FIG. 9 is analogous to that described with reference to FIG. 7, FIG. 8A and FIG. 8B except that in FIG. 9, the connector ends of each electrical cable are offset within the corresponding trunk section. Notably, one end of each trunk section includes a taper to enable stacking of the trunk sections. The electrical connector end in the taper extends into the taper, and in some embodiments, outside the taper of the corresponding trunk section. On the other hand, the electrical end opposite the taper is recessed into the trunk such that when a taper of one trunk section is received into he open end of another trunk section, the electrical connectors mate.

In some embodiments, both electrical connector ends can extend outside the trunk section, e.g., to define adapters that couple the trunk sections. By comparison, as best illustrated in FIG. 8A, and FIG. 8B, in alternative embodiments, the connector ends are located within the trunk sections.

Regardless of cable configuration (FIG. 8A, FIG. 8B, FIG. 9), the cables can be connected to the respective trunk sections via one or more screws, glue, or other fastening means. Moreover, each modular electrical connector end 100 (FIG. 1A-1E) and/or modular electrical connector end 200 (FIG. 2A-2E) can be formed as a clamshell housing to facilitate manufacture. The clamshell sections can be ultrasonically welded, glued, mechanically fastened, etc. at the time of manufacture.

Figure 10:
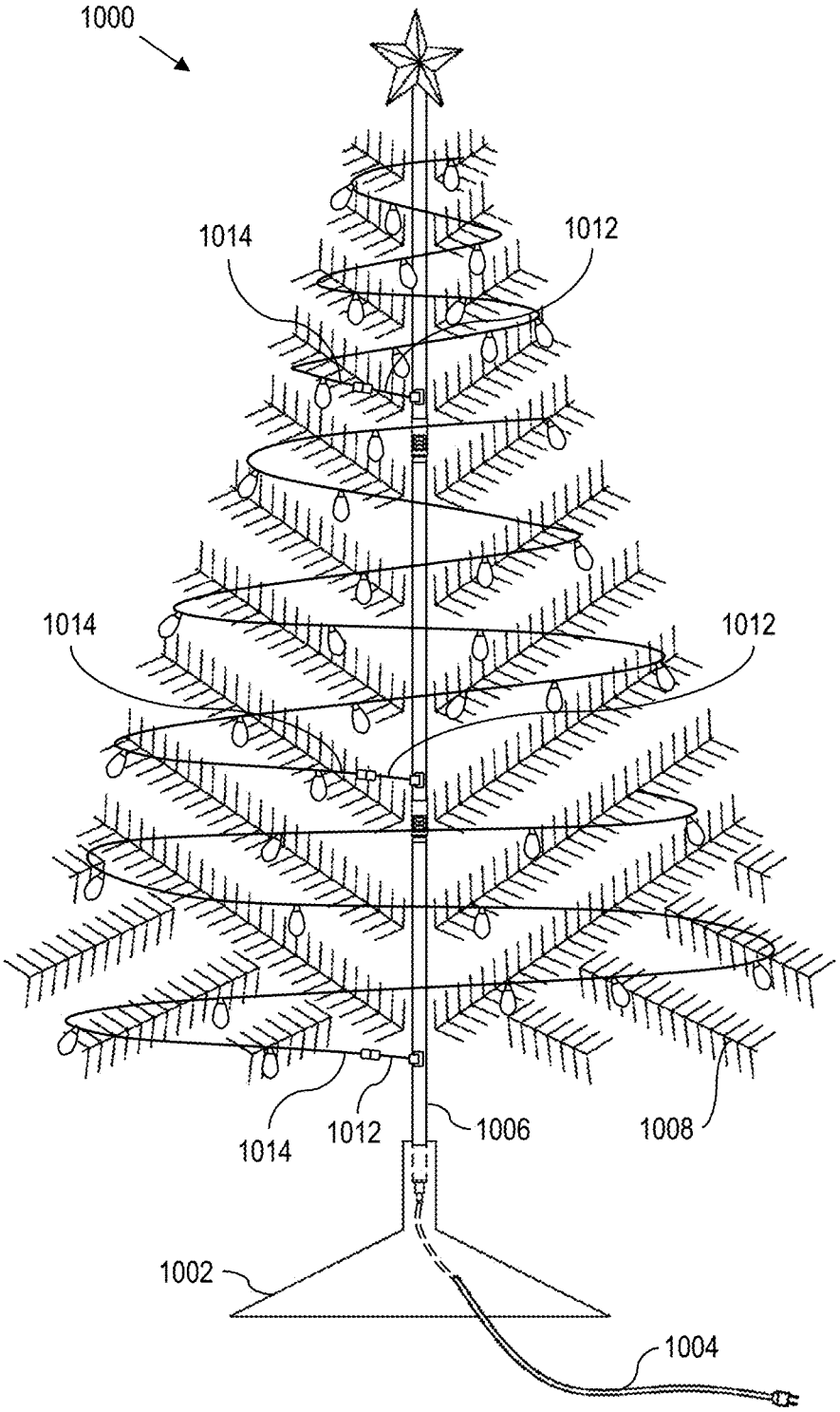
FIG. 10 illustrates an example decoration, implemented as an artificial illuminated tree, according to aspects of the present disclosure.

FIG. 10 illustrates an example decoration, implemented as an artificial illuminated tree 1000, according to aspects of the present disclosure. The artificial tree 1000 includes a stand 1002 to which power is provided via a power cord 1004. The power cord 1004 can mate with a connector in the stand 1002, which includes an electrical connector that correspondingly mates with an end of a trunk section 1006. As illustrated, three trunk sections 1006 are stacked together to form the trunk of the artificial tree. Each trunk section 1006 includes a cable assembly, which can be implemented according to any combination of embodiments disclosed in any of the preceding FIGS. 1A-9. Moreover, artificial tree branches 1008 are coupled to each trunk section 1006. In the illustrated view the cable assembly within each trunk section 1006 is not visible. However, the cable assembles in this embodiment include a courtesy extension cable 1012, which can be analogous that described with reference to FIG. 4B, 8B, combination thereof, etc. In this regard, each courtesy extension cable 1012 can electrically connect to one or more light strings 1014 strung along the artificial tree branches 1008. Alternatively, the light strings 1014 can plug into an outlet, which can be analogous that described with reference to FIG. 4C, 8A, combination thereof, etc.

Thus, electrical power is provided via the power cord 1004 to the base of the bottom-most trunk section 1006 via an electrical connector in the stand 1002. Power flows up the bottom-most trunk section 1006 via a bottom-most cable assembly (not shown). Power travels from the bottom-most cable assembly via the courtesy electrical extension cable 1012 to corresponding light string(s) on the artificial tree branches 1008 of the bottom-most trunk section. Power also travels to the intermediate trunk section 1006 via the corresponding intermediate cable assembly. Power travels from the intermediate cable assembly via the courtesy electrical extension cable 1012 to corresponding light string(s) on the artificial tree branches 1008 of the middle trunk section. Power also travels to the top-most trunk section 1006 via the corresponding top-most cable assembly. Power travels from the top-most cable assembly via the courtesy electrical extension cable 1012 to corresponding light string(s) on the artificial tree branches 1008 of the top-most trunk section. Power also travels to a star or other illuminable ornament at the top of the artificial tree.

Notably, where the trunk sections include branches thereof, and the branches include strings of lights pre-strung, the entire artificial tree can be set up in five steps, namely, by installing the bottom-most trunk section into the stand, stacking the intermediate trunk section into the bottom-most trunk section, stacking the top-most trunk section into the intermediate trunk section, adorning the top of the tree with a decoration (e.g., a star as shown), and plugging the power cord of the stand into a wall outlet.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. An illuminable decoration comprising:

a first trunk section and a second trunk section, the first trunk section and the second trunk section each comprised of a hollow tube;

a first cable assembly at least partially positioned within the hollow of the first trunk section, the first cable assembly comprising:

a first modular electrical connector end, the first modular electrical connector end having an inner socket comprising an insulator projection having a hollow therein and an outer plug that at least partially circumscribes the inner socket;

a second modular electrical connector end, the second modular electrical connector end having an inner plug and an outer socket that at least partially circumscribes the inner plug;

a first electrical wire electrically coupled between an electrical contact of the inner socket of the first modular electrical connector end and an electrical contact of the inner plug of the second modular electrical connector end; and a second electrical wire electrically coupled between an electrical contact of the outer plug of the first modular electrical connector end and an electrical contact of the outer socket of the second modular electrical connector end;

a second cable assembly at least partially positioned within the hollow of the second trunk section, the second cable assembly comprising at least one of:

a first modular electrical connector end, the first modular electrical connector end having an inner socket comprising an insulator projection having a hollow therein and an outer plug that circumscribes the inner socket; and a second modular electrical connector end, the second modular electrical connector end having an inner plug and an outer socket that circumscribes the inner plug;

wherein, when the first trunk section is assembled axially to the second trunk section end-to-end;

the first trunk section and the second trunk section are mechanically connected along an axial dimension;

the first cable assembly is rotatable relative to the second cable assembly such that the first cable assembly is mechanically and electrically connected to the second cable assembly so as to form a modular electrical distribution system; and the electrical contact of the inner socket of the first modular electrical connector end is offset relative to the axial dimension such that there is no coaxial electrical contact in the first modular connector end and there is no coaxial electrical contact in the second modular electrical connector end.

2. The illuminable decoration of claim 1, wherein:

when the first cable assembly is mechanically and electrically connected to the second cable assembly:

the inner socket of the first modular electrical connector end of the first cable assembly electrically and mechanically connects to the inner plug of the second modular electrical connector end of the second electrical assembly; and the outer plug of the first modular electrical connector end of the first cable assembly electrically and mechanically connects to the outer socket of the second modular electrical connector end of the second electrical assembly.

3. The illuminable decoration of claim 1, wherein:

the second modular electrical connector end further comprises a body;

the inner plug of the second modular electrical connector end comprises an inner insulator projecting from the body;

the electrical contact of the inner plug comprises a conductive material on an outside surface of the inner insulator;

the outer socket of the second modular electrical connector end comprises a tubular insulator that at least partially circumscribes and is spaced outwardly from the inner plug;

the electrical contact of the outer socket of the second modular electrical connector end comprises a conductive tab on an inside surface of the tubular insulator.

4. The illuminable decoration of claim 1, wherein:

the second modular electrical connector end further comprises a body;

the inner plug of the second modular electrical connector end comprises an inner insulator projecting from the body;

the electrical contact of the inner plug comprises a conductive material on an outside surface of the inner insulator;

the outer socket of the second modular electrical connector end comprises at least two arcuate sections that are spaced apart from each other, and together at least partially circumscribe the inner plug;

the electrical contact of the outer socket of the second modular electrical connector end comprises a conductive tab, on a select one of the at least two arcuate sections.

5. The illuminable decoration of claim 1, wherein:

the first cable assembly further comprises an electrical outlet electrically coupled to the first electrical wire and the second electrical wire.

6. The illuminable decoration of claim 5, wherein:

the outlet is physically coupled to a select one of the first modular electrical connector end or the second modular electrical connector end; and the electrical outlet comprises a receptacle that is exposed through an outside surface of the corresponding trunk section.

7. The illuminable decoration of claim 1, wherein:

the first cable assembly further comprises an extension cable electrically coupled to the first electrical wire and the second electrical wire.

8. The illuminable decoration of claim 7, wherein:

the extension cable is physically coupled to a select one of the first modular electrical connector end or the second modular electrical connector end; and the extension cable is exposed through an outside surface of the corresponding trunk section.

9. The illuminable decoration of claim 1, wherein the inner socket of the first modular electrical connector end, the inner plug of the second modular electrical connector end, the outer plug of the first modular electrical connector end, and the outer socket of the second modular electrical connector end have a cross-section orthogonal to an axial axis that defines concentric rings.

10. The illuminable decoration of claim 1 further comprising a string of lights electrically coupled to the first and second electrical wires of the first cable assembly.

11. An illuminable decoration comprising:

a first trunk section and a second trunk section, the first trunk section and the second trunk section each comprised of a hollow tube;

a first cable assembly at least partially positioned within the hollow of the first trunk section, the first cable assembly comprising:

a first modular electrical connector end, the first modular electrical connector end having an inner socket and an outer plug that at least partially circumscribes the inner socket;

a second modular electrical connector end, the second modular electrical connector end having an inner plug and an outer socket that at least partially circumscribes the inner plug;

a first electrical wire electrically coupled between an electrical contact of the inner socket of the first modular electrical connector end and an electrical contact of the inner plug of the second modular electrical connector end; and a second electrical wire electrically coupled between an electrical contact of the outer plug of the first modular electrical connector end and an electrical contact of the outer socket of the second modular electrical connector end;

wherein the inner socket of the first modular electrical connector end comprises a tubular insulator, and the electrical contact of the inner socket is implemented as a conductive tab on an inside surface of the tubular insulator; and the electrical contact of the outer plug of the first modular electrical connector end comprises a conductive material on an outside surface of the tubular insulator;

a second cable assembly at least partially positioned within the hollow of the second trunk section, the second cable assembly comprising at least one of:

a first modular electrical connector end, the first modular electrical connector end having an inner socket and an outer plug that circumscribes the inner socket; and a second modular electrical connector end, the second modular electrical connector end having an inner plug and an outer socket that circumscribes the inner plug;

wherein, when the first trunk section is assembled to the second trunk section end-to-end, the first trunk section and the second trunk section are mechanically connected along an axial dimension, and the first cable assembly is mechanically and electrically connected to the second cable assembly so as to form a modular electrical distribution system.

12. The illuminable decoration of claim 11 further comprising:

an outer wall defined by an insulator that forms a concentric outer ring circumscribing and spaced outwardly from the tubular insulator.

13. The illuminable decoration of claim 11 further comprising:

at least two outer wall segments, each outer wall segment spaced by a gap at each end thereof, the at least two outer wall segments spaced outwardly from the tubular insulator.

14. The illuminable decoration of claim 11, wherein:

the first modular electrical connector end further comprises a body, wherein:

the tubular insulator is the only projection extending from a face of the body.

15. A cable assembly comprising:

a first modular electrical connector end, the first modular electrical connector end having an inner socket comprising an insulator projection having a hollow therein and an outer plug that at least partially circumscribes and is spaced from the inner socket;

a second modular electrical connector end, the second modular electrical connector end having an inner plug and an outer socket that at least partially circumscribes and is spaced from the inner plug;

a first electrical wire electrically coupled between an electrical contact of the inner socket of the first modular electrical connector end and an electrical contact of the inner plug of the second modular electrical connector end; and a second electrical wire electrically coupled between an electrical contact of the outer plug of the first modular electrical connector end and an electrical contact of the outer socket of the second modular electrical connector end;

wherein, when two cable assemblies are assembled axially together end-to-end:

a first one of the two cable assemblies is rotatable relative to a second one of the two cable assemblies and is mechanically connected along an axial dimension so as to form a modular electrical distribution system, such that:

the inner socket of the first modular electrical connector end of a first one of the cable assemblies electrically and mechanically connects to the inner plug of the second modular electrical connector end of a second one of the cable assemblies, the outer plug of the first modular electrical connector end of the first one of the cable assemblies electrically and mechanically connects to the outer socket of the second modular electrical connector end of the second one of the cable assemblies; and the electrical contact of the inner socket of the first modular electrical connector end is offset relative to the axial dimension such that there is no coaxial electrical contact in the first modular connector end and there is no coaxial electrical contact in the second modular electrical connector end.

16. The cable assembly of claim 15, wherein:

the first cable assembly further comprises an electrical outlet electrically coupled to the first electrical wire and the second electrical wire.

17. The cable assembly of claim 16, wherein:

the outlet is physically coupled to a select one of the first modular electrical connector end or the second modular electrical connector end; and the electrical outlet comprises a receptacle that is exposed through an outside surface of the corresponding trunk section.

18. The cable assembly of claim 15, wherein:

the first cable assembly further comprises an extension cable electrically coupled to the first electrical wire and the second electrical wire.

19. The cable assembly of claim 18, wherein:

the extension cable is physically coupled to a select one of the first modular electrical connector end or the second modular electrical connector end; and the extension cable is exposed through an outside surface of the corresponding trunk section.

20. A cable assembly comprising:

a first modular electrical connector end, the first modular electrical connector end having an inner socket and an outer plug that at least partially circumscribes and is spaced from the inner socket;

a second modular electrical connector end, the second modular electrical connector end having an inner plug and an outer socket that at least partially circumscribes and is spaced from the inner plug;

a first electrical wire electrically coupled between an electrical contact of the inner socket of the first modular electrical connector end and an electrical contact of the inner plug of the second modular electrical connector end; and a second electrical wire electrically coupled between an electrical contact of the outer plug of the first modular electrical connector end and an electrical contact of the outer socket of the second modular electrical connector end;

wherein:

when two cable assemblies are assembled together end-to-end, the two cable assemblies are mechanically connected along an axial dimension so as to form a modular electrical distribution system, such that the inner socket of the first modular electrical connector end of a first one of the cable assemblies electrically and mechanically connects to the inner plug of the second modular electrical connector end of a second one of the cable assemblies, and the outer plug of the first modular electrical connector end of the first one of the cable assemblies electrically and mechanically connects to the outer socket of the second modular electrical connector end of the second one of the cable assemblies;

the inner socket of the first modular electrical connector end comprises a tubular insulator, the electrical contact of the inner socket is implemented as a conductive tab on an inside surface of the tubular insulator; and the electrical contact of the outer plug of the first modular electrical connector end comprises a conductive material on an outside surface of the tubular insulator.

21. The cable assembly of claim 20 further comprising:

an outer wall defined by an insulator that forms a concentric outer ring circumscribing and spaced outwardly from the tubular insulator.

22. The cable assembly of claim 20 further comprising:

at least two outer wall segments, each outer wall segment spaced by a gap at each end thereof, the at least two outer wall segments spaced outwardly from the tubular insulator.

23. The cable assembly of claim 20, wherein:

the first modular electrical connector end further comprises a body, wherein:

the tubular insulator is the only projection extending from a face of the body.

24. A cable assembly comprising:

a first modular electrical connector end, the first modular electrical connector end having an inner socket and an outer plug that at least partially circumscribes and is spaced from the inner socket;

a second modular electrical connector end, the second modular electrical connector end having an inner plug and an outer socket that at least partially circumscribes and is spaced from the inner plug;

a first electrical wire electrically coupled between an electrical contact of the inner socket of the first modular electrical connector end and an electrical contact of the inner plug of the second modular electrical connector end; and a second electrical wire electrically coupled between an electrical contact of the outer plug of the first modular electrical connector end and an electrical contact of the outer socket of the second modular electrical connector end;

wherein:

when two cable assemblies are assembled together end-to-end, the two cable assemblies are mechanically connected along an axial dimension so as to form a modular electrical distribution system, such that the inner socket of the first modular electrical connector end of a first one of the cable assemblies electrically and mechanically connects to the inner plug of the second modular electrical connector end of a second one of the cable assemblies, and the outer plug of the first modular electrical connector end of the first one of the cable assemblies electrically and mechanically connects to the outer socket of the second modular electrical connector end of the second one of the cable assemblies;

the second modular electrical connector end further comprises a body;

the inner plug of the second modular electrical connector end comprises an inner insulator projecting from the body;

the electrical contact of the inner plug comprises a conductive material on an outside surface of the inner insulator;

the outer socket of the second modular electrical connector end comprises a tubular insulator that at least partially circumscribes and is spaced outwardly from the inner plug; and the electrical contact of the outer socket of the second modular electrical connector end comprises a conductive tab on an inside surface of the tubular insulator.

25. The cable assembly of claim 24, wherein:

the outer socket of the second modular electrical connector end further comprises at least two arcuate sections that are spaced apart from each other, and together at least partially circumscribe the inner plug; and the electrical contact of the outer socket of the second modular electrical connector end comprises the conductive tab on at least one of the at least two arcuate sections.

* * * * *